US010176977B2

(12) United States Patent
Wang

(10) Patent No.: US 10,176,977 B2
(45) Date of Patent: Jan. 8, 2019

(54) ION SOURCE FOR SOFT ELECTRON IONIZATION AND RELATED SYSTEMS AND METHODS

(71) Applicant: Agilent Technologies, Inc., Santa Clara, CA (US)

(72) Inventor: Mingda Wang, Fremont, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 253 days.

(21) Appl. No.: 14/950,983

(22) Filed: Nov. 24, 2015

(65) Prior Publication Data

US 2016/0172146 A1 Jun. 16, 2016

Related U.S. Application Data

(60) Provisional application No. 62/091,204, filed on Dec. 12, 2014.

(51) Int. Cl.
*H01J 49/00* (2006.01)
*H01J 49/14* (2006.01)

(52) U.S. Cl.
CPC ..... *H01J 49/147* (2013.01)

(58) Field of Classification Search
CPC ..... H01J 49/147; H01J 49/40; H01J 49/42; H01J 49/48; H01J 49/063; H01J 49/0022; H01J 49/422; H01J 49/4255; H01J 2237/24485; H01J 2237/30472; H01J 2237/31703; H01J 2237/0812; H01J 2237/0041
See application file for complete search history.

(56) References Cited

U.S. PATENT DOCUMENTS 2,983,842 A * 5/1961 Hrbek ..... H01J 3/029 313/455
3,315,125 A * 4/1967 Frohlich ..... H01J 27/10 313/230
3,924,134 A 12/1975 Uman et al.
5,107,109 A 4/1992 Stafford et al.
5,317,161 A 5/1994 Chalupka et al.
(Continued)

FOREIGN PATENT DOCUMENTS

DE 112010003411 8/2012
EP 0 408 487 A2 1/1991
(Continued)

OTHER PUBLICATIONS

Search Report for GB1411010.0 dated Dec. 30, 2014.
(Continued)

*Primary Examiner* — Wyatt Stoffa
*Assistant Examiner* — Hsien Tsai

(57) ABSTRACT

An ion source is configured for soft electron ionization and produces a low electron-energy, yet high-intensity, electron beam. The ion source includes an electron source that produces the electron beam and transmits it into an ionization chamber. The electron beam interacts with sample material in the ionization chamber to produce an ion beam that may be transmitted to a downstream device. The electron source is configured for generating a virtual cathode upstream of the ionization chamber, which enhances the intensity of the electron beam.

20 Claims, 17 Drawing Sheets

(56) References Cited

U.S. PATENT DOCUMENTS

| | | | | |
|---|---|---|---|---|
| 5,340,983 | A | 8/1994 | Deinzer et al. | |
| 5,457,324 | A | 10/1995 | Armour et al. | |
| 5,493,115 | A | 2/1996 | Deinzer et al. | |
| 5,777,205 | A | 7/1998 | Nakagawa et al. | |
| 5,838,120 | A | 11/1998 | Semenkin et al. | |
| 5,942,752 | A | 8/1999 | Wang | |
| 6,498,348 | B2 | 12/2002 | Aitken | |
| 6,630,664 | B1 | 10/2003 | Syage et al. | |
| 7,060,987 | B2 | 6/2006 | Lee et al. | |
| 7,071,466 | B2 | 7/2006 | Glukhoy | |
| 7,259,019 | B2 | 8/2007 | Pawliszyn et al. | |
| 7,291,845 | B2 | 11/2007 | Moeller et al. | |
| 7,345,275 | B2 | 3/2008 | Amirav et al. | |
| 7,683,314 | B2 | 3/2010 | Green et al. | |
| 7,807,963 | B1 | 10/2010 | Bier | |
| 8,395,112 | B1 | 3/2013 | Bier | |
| 2002/0043621 | A1 | 4/2002 | Aitken | |
| 2003/0137229 | A1 | 7/2003 | Amirav | |
| 2004/0251409 | A1 | 12/2004 | Le Blanc | |
| 2005/0184735 | A1 | 8/2005 | Arnold et al. | |
| 2005/0230614 | A1 | 10/2005 | Glukhoy | |
| 2005/0276727 | A1 | 12/2005 | Pawlisyn et al. | |
| 2006/0243901 | A1 | 11/2006 | Barket et al. | |
| 2007/0057172 | A1 | 3/2007 | Wang | |
| 2007/0114374 | A1 | 5/2007 | Prest et al. | |
| 2007/0284521 | A1 | 12/2007 | Green et al. | |
| 2011/0111443 | A1 | 5/2011 | Nishimura et al. | |
| 2011/0147609 | A1 | 6/2011 | Shichi et al. | |
| 2012/0267525 | A1 | 10/2012 | Sasai et al. | |
| 2013/0103337 | A1 | 4/2013 | Eiler | |
| 2014/0097338 | A1 | 4/2014 | Eiler | |
| 2015/0028222 | A1 | 1/2015 | Denning et al. | |
| 2015/0380228 | A1* | 12/2015 | Schanen ..... | H01J 49/147 250/281 |

FOREIGN PATENT DOCUMENTS

| | | | |
|---|---|---|---|
| EP | 0 773 578 | A1 | 5/1997 |
| EP | 1355341 | A1 | 10/2003 |
| JP | S6024039 | A | 2/1985 |
| JP | H02121233 | A | 5/1990 |
| JP | 2001126630 | A | 2/2011 |
| RU | SU 1 308 091 | A | 6/1988 |
| WO | 2004097352 | A2 | 11/2004 |
| WO | 2014/099430 | A1 | 6/2014 |
| WO | 2014128462 | A2 | 8/2014 |

OTHER PUBLICATIONS

European Search Report for EP14 167 844.1 dated Mar. 2, 2015.
European Search Report for EP 14 16 8583, dated Feb. 25, 2015.
Zavilopulo A N et al.; "An upgraded ion source for a mass spectrometer", Instruments and Experimental Techniques, Kluwer Academic Publishers—Plenum Publishers, NE, vol. 55, No. 1, Feb. 14, 2012, pp. 65-71.
Allegretti P E et al.; "Mass spectrometry as a valuable tool for the study of tautomerism of amides and thioamides", Journal of Molecular Structure (Theochem), Elsevier Science Publishers B.V., Amsterdam, NL, vol. 589-590, Aug. 16, 2002 pp. 161-170.
Great Britain Search Report for Application No. GB1408113.7, dated Oct. 30, 2014.
Finkelstein, Theodore A.; A High Efficiency Ion Source; The Review of Scientific Instruments; Mar. 1940; vol. 11; pp. 94-97.
Carlston, C.E., et al.; High Efficiency Low-Pressure Ion Source; The Review of Scientific Instruments; Sep. 1962; vol. 33, No. 9; pp. 905-911.
Koontz,S.L., et al., A Very High Yield Electron Impact Ion Source for Analytical Mass Spectrometry; International Journal of Mass Spectrometry and Ion Physics; 1981; vol. 37; pp. 227-239.
Dekieviet, M., et al.; Design and Performance of a Highly Efficient Mass Spectrometer for Molecular Beams; The Review of Scientific Instruments; May 2000; vol. 71, No. 5; pp. 905-991.
Yue, B., et al.; Electron Ionization in Superimposed Magnetic and Radio Frequency Quadrupolar Electric Fields; Anal Chem; 2005; vol. 77; pp. 4160-4166.
Yue, B., et al.; Superimposition of a Magnetic Field Around an Ion Guide for Electronic Ionization Time-of-Flight Mass Spectrometry; Anal Chem; 2005; vol. 77; pp. 4167-4175.
Chang, J., et al.; Effect of Magnetic Field in Electron-Impact Ion Sources and Simulation of Electron Trajectories; The Review of Scientific Instruments; 2006; vol. 77; 085107.
Kalinin, A.V., et al,; Ion Source with Longitudinal Ionization of a Molecular Beam by an Electron Beam in a Magnetic Field, Instruments and Experimental Techniques; 2006; vol. 49, No. 5, pp. 709-713.
Alderwick, A.R., et al., The Review of Scientific Instruments; 2008; vol. 79, 123301.
Ahn, et al.; Measurement of Ion Kinetic-energy Distributions in Electron-impact Ion Sources of a Quadrupole Mass Spectrometer, Journal of the Korean Physical Society; vol. 59, No. 4; Oct. 2011; pp. 2670-2675.
Non-final Office Action dated Feb. 24, 2015 from U.S. Appl. No. 13/925,470.
Final Office Action dated Aug. 21, 2015 from U.S. Appl. No. 13/925,470.
U.K. Search Report dated Jun. 10, 2016 from related U.K Application No. GB1521498.4.
U.K. Examination Report dated Oct. 30, 2017 from related U.K Application No. GB1521498.4.

* cited by examiner

ION SOURCE FOR SOFT ELECTRON IONIZATION AND RELATED SYSTEMS AND METHODS

RELATED APPLICATIONS

This application claims the benefit of U.S. Provisional Patent Application Ser. No. 62/091,204, filed Dec. 12, 2014, titled "ION SOURCE FOR SOFT ELECTRON IONIZATION AND RELATED SYSTEMS AND METHODS," the content of which is incorporated by reference herein in its entirety.

TECHNICAL FIELD

The present invention relates to ion sources utilizing an electron beam, such as may be employed in mass spectrometry, and more particularly to ion sources configured for soft electron ionization.

BACKGROUND

A mass spectrometry (MS) system in general includes an ion source for ionizing components of a sample of interest, a mass analyzer for separating the ions based on their differing mass-to-charge ratios (or m/z ratios, or more simply "masses"), an ion detector for counting the separated ions, and electronics for processing output signals from the ion detector as needed to produce a user-interpretable mass spectrum. Typically, the mass spectrum is a series of peaks indicative of the relative abundances of detected ions as a function of their m/z ratios. The mass spectrum may be utilized to determine the molecular structures of components of the sample, thereby enabling the sample to be qualitatively and quantitatively characterized.

One example of an ion source widely used in MS is an electron ionization (EI) source. In a typical EI source, sample material is introduced into an ionization chamber in the form of a molecular vapor. An electron emitter, typically a thermionic cathode such as a heated filament composed of a refractory material (e.g., tungsten), is employed to emit energetic electrons. The emitted electrons are then collimated and accelerated as a beam into the ionization chamber under the influence of a potential difference impressed between the filament and an anode. The sample material is introduced into the ionization chamber along a path that intersects the path of the electron beam. Ionization of the sample material occurs as a result of the electron beam bombarding the sample material in the region where the sample and electron paths intersect. The primary reaction of the ionization process may be described by the following relation: $M+e^{-}\rightarrow M^{*+}+2e^{-}$, where M designates an analyte molecule, $e^{-}$ designates an electron, and $M^{*+}$ designates the resulting molecular ion. That is, electrons approach a molecule closely enough to cause the molecule to lose an electron by electrostatic repulsion and, consequently, a singly-charged positive ion is formed. A potential difference is employed to attract the ions formed in the ionization chamber toward an exit aperture, after which the resulting ion beam is accelerated into a downstream device such as the mass analyzer or first to an intervening component such as an ion guide, mass filter, etc.

The electric field utilized to accelerate the electrons into the ionization chamber is usually generated by a filament voltage that is negative (or less positive) relative to the ionization chamber voltage. In many EI ion sources, a more negative electron repeller, positioned further away from ionization chamber, is used to push more electrons to enter the ionization chamber. In some of the known EI ion sources, an electron lens is disposed between filament and ionization chamber to pull electrons away from the filament. While electrons collide with gas samples, sample neutrals are ionized if the electron energy is larger than sample ionization potentials. Commonly, the electron beam enters the ionization chamber with an energy of around 20-150 eV since the typical sample ionization potential is between 7.5 to 15 eV. In such an EI ion source, molecules are extensively fragmented and library-searchable mass spectra are accomplished. However, in some cases, for example in cases involving structure elucidation or identification of unknown compounds, mass spectra with rich molecular ions and/or higher mass diagnostic ions are preferred. This has been practiced in some of the known EI ion sources by operating at a lower electron energy (8-20 eV), which is called "low electron energy EI" or "soft EI." In the soft EI mode, the voltage difference between the filament and the ionization chamber needs to be set at near the sample ionization potential, e.g., 10 eV, which results in low electric field strength between the filament and the ionization chamber. Unfortunately, the low electric field strength prevents the EI source from generating a stable higher intensity electron beam. Thus, past attempts to implement soft ionization via EI have been limited to producing undesirably low EI signal intensity.

Generally, when electron energy is above 20 eV, known EI ion sources show reasonable performance. However, when electron energy is less than 20 eV, it is difficult for known EI ion sources to generate a stable and high intensity low electron energy electron beam. Thus, known EI ion sources are not optimized for soft EI.

Therefore, there is a need for EI ion sources that are more effective for implementing soft ionization.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an ion source includes: a body surrounding an ionization chamber; an electron extractor configured for accelerating electrons into the ionization chamber; an electron source outside the ionization chamber and comprising an electron repeller, a thermionic cathode, and an electron lens between the thermionic cathode and the electron extractor; and a voltage source configured for: applying respective voltages to the electron repeller, the thermionic cathode, the electron lens, and the electron extractor effective for: emitting electrons from the thermionic cathode; accelerating the electrons toward the ionization chamber; and generating a potential valley at the electron lens effective for decelerating the electrons and forming at the electron lens a virtual cathode comprising the decelerated electrons.

According to another embodiment, a mass spectrometer (MS) includes: an ion source according to any of the embodiments disclosed herein; and a mass analyzer downstream from the ionization chamber.

According to another embodiment, a method for producing an electron beam for electron ionization includes: producing electrons; accelerating the electrons toward an ionization chamber; decelerating the electrons to a level effective for forming a virtual cathode outside of the ionization chamber, the virtual cathode comprising the decelerated electrons; and accelerating the electrons from the virtual cathode into the ionization chamber.

According to another embodiment, a method for analyzing sample material includes:

producing an electron beam according to the method of claim 14; producing ions by directing sample material into the ionization chamber toward the electrons; and transmitting the ions from the ionization chamber to a mass analyzer.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
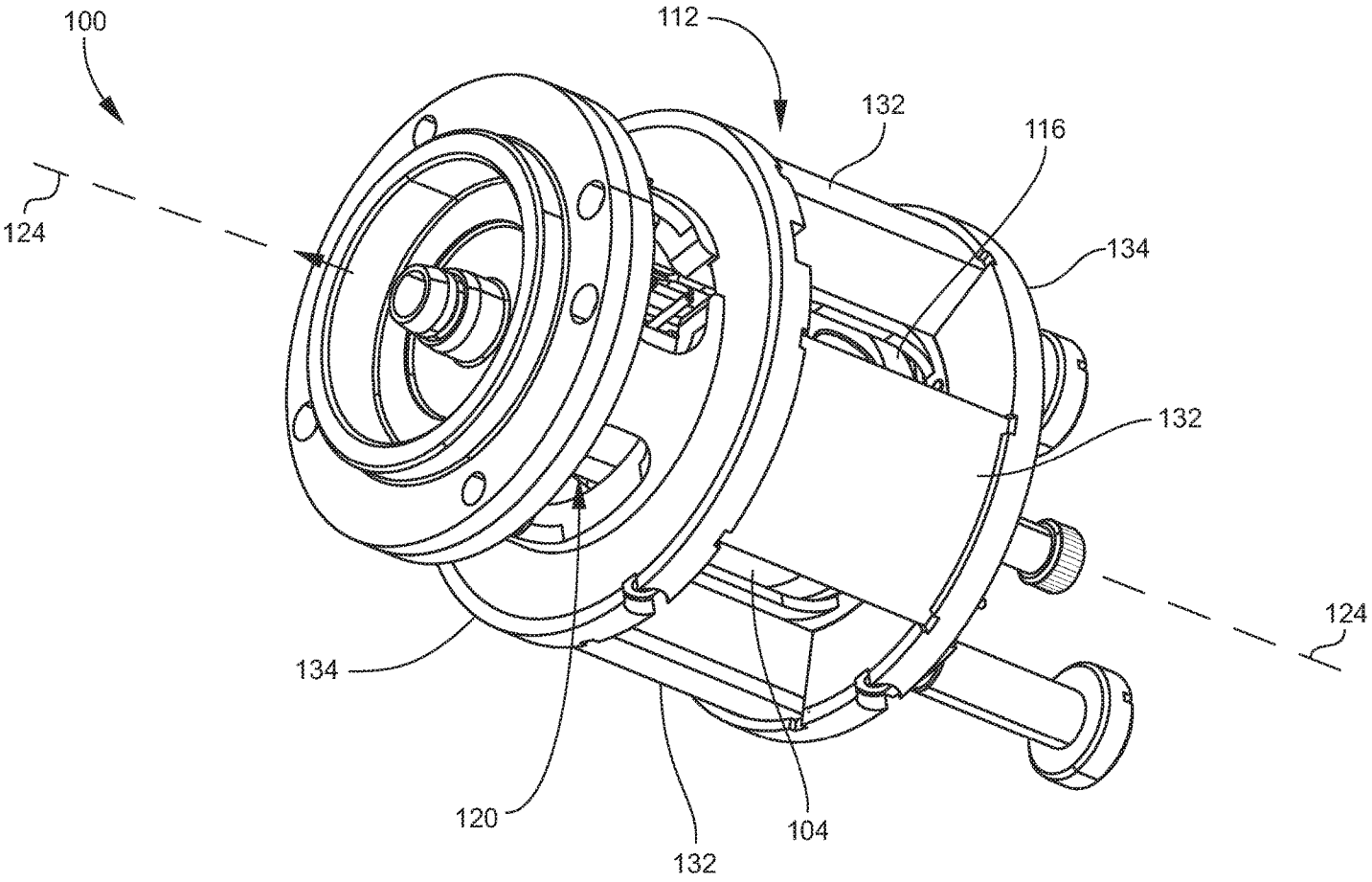
FIG. 1 is a perspective view of an example of an ion source according to some embodiments disclosed herein.
Figure 2:
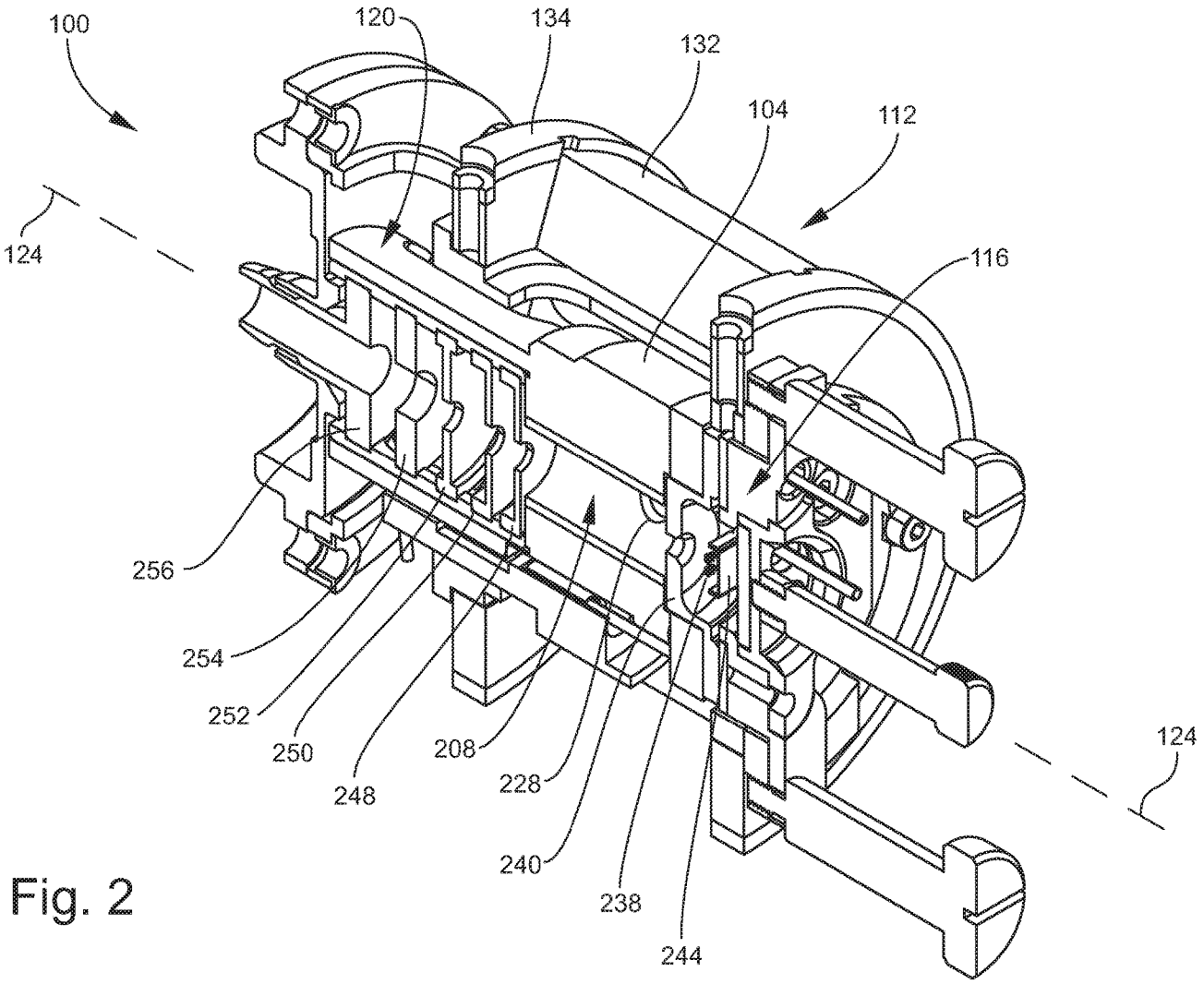
FIG. 2 is a perspective cross-sectional view of the ion source illustrated in FIG. 1.

FIG. 1 is a perspective view of an example of an ion source 100 according to some embodiments. FIG. 2 is a perspective cross-sectional view of the ion source 100 illustrated in FIG. 1. In the illustrated embodiment, the ion source 100 generally includes a body 104 defining an internal ionization chamber or volume 208, a magnet assembly 112, an electron source 116, and a lens assembly 120.

The ion source 100 may have an overall geometry or configuration generally arranged about a source axis 124. In operation, the ion source 100 produces an electron beam along the source axis 124, and may admit a stream of sample material to be ionized in any direction relative to the source axis 124. The sample material to be analyzed may be introduced to the ion source 100 by any suitable means, including hyphenated techniques in which the sample material is the output of an analytical separation instrument such as, for example, a gas chromatography (GC) instrument. The ion source 100 subsequently produces ions and focuses the ions into an ion beam along the source axis 124. The ions exit the ion source 100 along the source axis 124 and enter the next ion processing device, which may have an ion entrance along the source axis 124.

The ionization chamber 208 has a length along a source axis 124 from a first end to a second end. A sample inlet 228 is formed through the body 104 at any suitable location to provide a path for directing sample material from a sample source into the ionization chamber 208 where the sample material interacts with the electron beam. The axial length of the ionization chamber 208 may be selected to provide a relatively long viable electron beam region available to ionize the desired analyte molecules, thereby increasing the ionization efficiency of the ion source 100 and consequently the sensitivity of the instrument as a whole.

The magnet assembly 112 coaxially surrounds the body 104. The magnet assembly 112 is configured for generating a uniform axial magnetic field in the ionization chamber 208, which focuses and compresses the electron beam and the resulting ion beam along the source axis 124. The magnetically constrained electron beam and relatively long ionization chamber 208 may enable the generation of an ion beam well suited for improved extraction (emittance) out from the ionization chamber 208 and ultimately into a downstream ion processing device such as, for example, a mass analyzer, or another type of device that precedes the mass analyzer, such as an ion guide, an ion trap, a mass filter, a collision cell, etc. The ion beam may be extracted without suffering the ion losses known to occur in Nier-type ion sources, where a large number of ions are drawn out to the filaments or are defocused and neutralized (lost) upon collision with the inner surfaces of the ionization chamber 208. The magnet assembly 112 may include a plurality of magnets 132 circumferentially spaced from each other about the source axis 124. The illustrated embodiment includes a symmetrical arrangement of four magnets 132 that are affixed to ring-shaped yokes 134. The magnets 132 may be permanent magnets or electromagnets. The sample inlet 228, and other components such as electrical conduits, may be positioned in the gap between any pair of adjacent magnets 132. The magnets 132, although spaced from each other by gaps, are symmetrically arranged about the source axis 124 and the axial magnetic field generated is uniform.

The electron source 116 may be any device configured for producing electrons and directing an electron beam through the ionization chamber 208 from the first end. In the illustrated embodiment, the electron source 116 includes one or more cathodes 238. The cathode 238 is configured for thermionic emission, and thus may be or include one or more filaments (or alternatively coatings on cores) composed of a thermionically emissive material such as, for example, rhenium or tungsten-rhenium alloy. The cathode 238 is heated to a temperature sufficient to produce thermionic emission. Heating is typically done by running an electrical current through the cathode 238. The current may be adjusted to adjust the electron energy, which is typically set to around 70 eV but may be lower or higher. The electron source 116 also includes an ion repeller 240 and an electron reflector 244 (plate or electrode). The cathode 238 is positioned between the electron reflector 244 and the ion repeller 240 in what may be considered as an electron source region separated from the ionization chamber 208 by the ion repeller 240. The ion repeller 240 (which may also be considered to be an electron extractor) may be configured as a wall or plate having an aperture on the source axis 124. The electron energy is set by the voltages applied to the ion repeller 240 and the electron reflector 244. A voltage applied to the electron reflector 244 accelerates the as-generated electrons toward the lens assembly 120. For this purpose, an axial voltage gradient may be applied between the electron reflector 244 and any suitable conductive element (anode) downstream of the cathode 238, such as an "extractor" of the lens assembly 120 as described below. The voltage applied to the electron reflector 244 is typically negative but more generally is less positive than the ion repeller 240 and other downstream optics up to a "first lens element" of the lens assembly 120, described below. The electron reflector 244 and cathode 238 may be operated at equal potentials, or the electron reflector 244 may be more negative than the cathode 238 to assist in repelling electrons into the ionization chamber 208.

The lens assembly 120 is positioned at the second end of the ionization chamber 208, axially opposite to the electron source 116. The lens assembly 120 is configured, among other things, for directing an ion beam out from the ionization chamber 208 along the source axis 124 and into the next ion processing device. For this purpose, the lens assembly 120 includes a plurality of lens elements (or electrodes) independently addressable by voltage sources. Each lens element may have an aperture or slot on the source axis 124. In the illustrated embodiment, the lens assembly 120 includes an ion extraction lens (or ion extractor) 248, a first lens element (or electron reflector) 250 spaced from the extractor 248 along the source axis 124, a second lens element (or ion reflector) 252 spaced from the first lens element 250 along the source axis 124, and an ion source exit lens element (or ion beam focusing lens element) 256 spaced from the second lens element 252 along the source axis 124. The ion source exit lens element 256 may be configured or also serve as the entrance lens element into an ion processing device. The lens assembly 120 may also include one or more additional ion focusing lens elements 254 between the second lens element 252 and the ion source exit lens element 256, which may be utilized for focusing the ion beam. The ion repeller 240 and the extractor 248 may be considered as being the axial first and second ends, respectively, of the ionization chamber 208. As appreciated by persons skilled in the art, a voltage of appropriate magnitude may be applied to the extractor 248 to assist in drawing the ion beam out from the ionization chamber 208.

The first lens element 250 is positioned just outside the ionization chamber 208, and is directly adjacent to the extractor 248 on the downstream side thereof. A voltage of appropriate magnitude may be applied to the first lens element 250 to reflect the electron beam back into the ionization chamber 208. Accordingly, the cathode 238 (or the cathode 238 and electron reflector 244) and the first lens element 250 cooperatively work to reflect the electron beam back and forth through the ionization chamber 208 along the source axis 124, thereby intensifying the electron density available for EI ionization of analytes in the ionization chamber 208.

To reflect electrons back into the ionization chamber 208, a voltage of relatively high magnitude may be applied to the first lens element 250. This may result in the creation of ions generally in the region between the first lens element 250 and the extractor 248, which may be referred to as an ion trapping region. In comparison to the ionization chamber 208, the energy in this region is low and hence ions created in this region may have undesirably low ion energies. Consequently, these ions are subject to becoming trapped in this region. These ions may be referred to herein as "low energy" or "lower energy" or "trapped" ions, which in the present context refers to ions having energies low enough to be capable of being trapped in the trapping region under the operating conditions contemplated for the ion source 100. By comparison, "high energy" or "higher energy" or "non-trapped" ions, typically those produced in the ionization chamber 208, are capable of penetrating the lens assembly 120 and entering the downstream ion processing device. Ion trapping may lead to undesirable space charge and ion current instabilities, consequently resulting in undesirable erratic performance.

The second lens element 252 is provided to substantially reduce or eliminate ion trapping in the region between the second lens element 252 and the extractor 248. The voltage set on the second lens element 252 may be more positive than the voltage set on the first lens element 250. Consequently, the second lens element 252 reflects the low energy ions back toward the first lens element 250, and these ions then collide with the first lens element 250 and are neutralized. In addition, the first lens element 250 may be positioned as close as practicable to the extractor 248 to minimize ion trapping in the trapping region.

Figure 3:
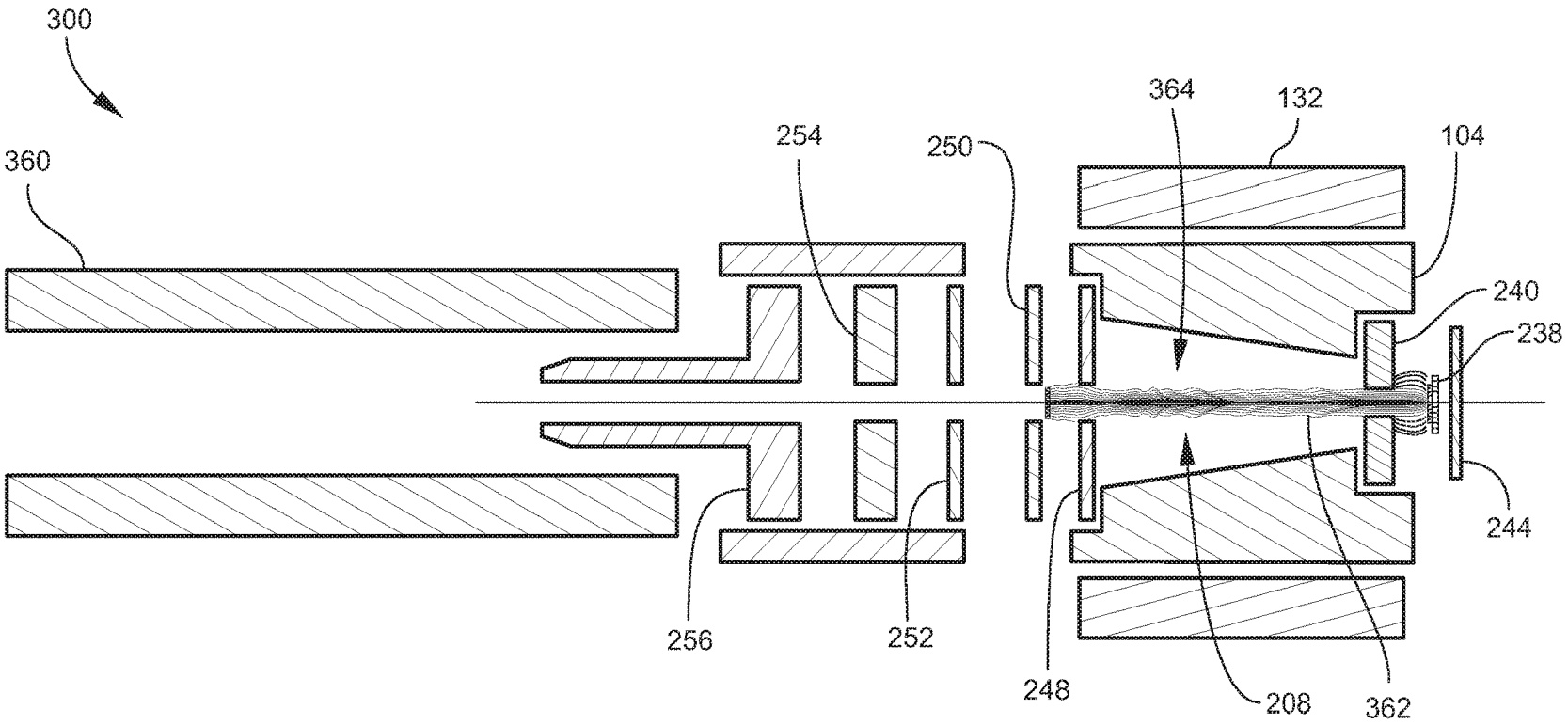
FIG. 3 is a model of an example of ion source, such as illustrated in FIGS. 1 and 2, generated by ion simulation software according to an embodiment.

FIG. 3 is a model of an ion source 300 generated by ion simulation software. The model corresponds to a cross-sectional side view of the ion source 300. The ion source 300 is generally similar to the ion source 100 described above and illustrated in FIGS. 1 and 2, and accordingly like components are designated by like reference numerals. The model includes a radio frequency (RF) quadrupole mass filter 360 positioned on-axis with the ion source 300 just downstream of the exit lens element 256. FIG. 3 shows an intense electron beam 362 concentrated along the source axis in which electrons are reflected back and forth between the cathode 238 and the first lens element 250. In this simulation the magnetic field strength was 750 gauss. In practice, stronger or weaker magnetic fields may be employed.

FIG. 3 also illustrates an embodiment in which at least a portion 364 of the ionization chamber 208 (such as a portion defined by an inside surface or surfaces of the body 104) is tapered or conical, diverging in the direction of the lens assembly 120. That is, the cross-sectional area of the ionization chamber 208 gradually increases in the direction of the lens assembly 120. This varying geometry subtly attenuates the electrical field, which may cause ions to travel preferentially in the direction of the lens assembly 120 and succeeding ion processing device.

Figure 4:
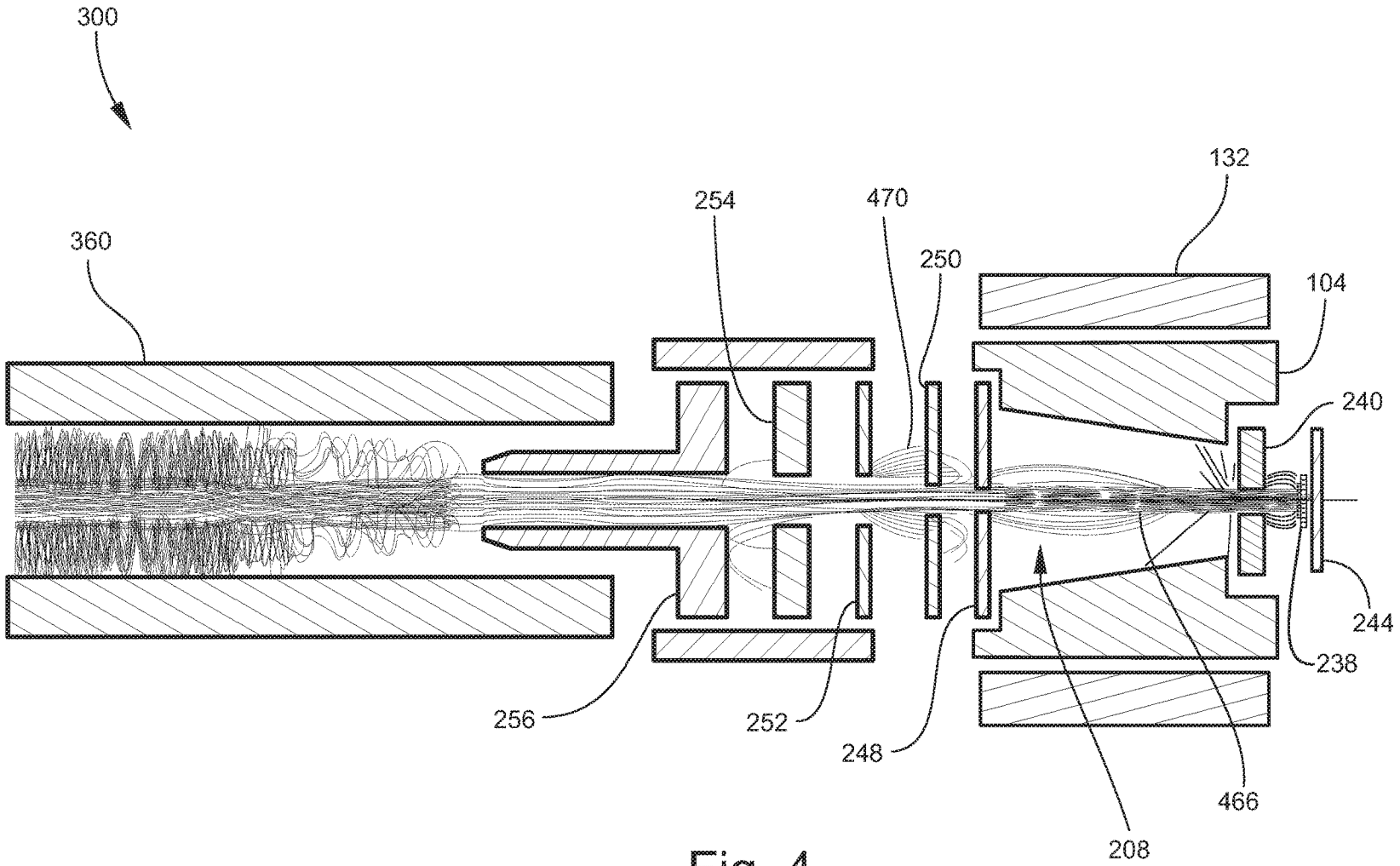
FIG. 4 is the same model as FIG. 3, but showing the ion trajectories, including an ion beam constrained along the source axis, according to an embodiment.
Figure 5:
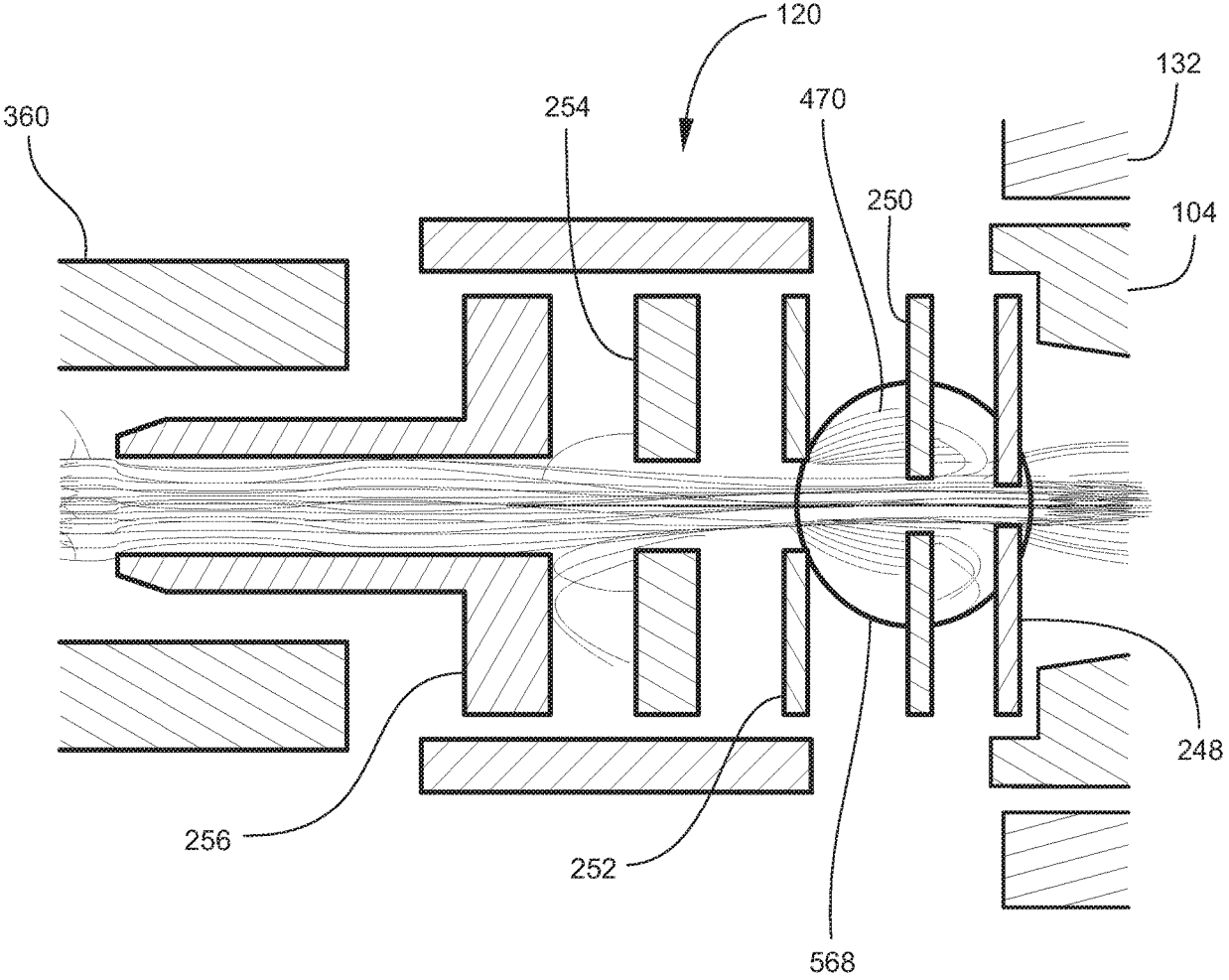
FIG. 5 is a closer view of the region around a lens assembly of the modeled ion source illustrated in FIG. 4.

FIG. 4 is the same model as FIG. 3, but showing the ion trajectories, including an ion beam 466 constrained along the source axis. FIG. 5 is a closer view of the region around the lens assembly 120. The ion trapping region is indicated by a circle 568. Low energy ions 470 are shown in FIGS. 4 and 5 being reflected from the second lens element 252 and colliding with the first lens element 250. FIGS. 4 and 5 demonstrate that ion sources disclosed herein are capable of significantly reducing or eliminating ion trapping while maintaining highly efficient transmission of higher energy ions created in the ion volume of the ion source. It will be noted that while the ion source 300 in FIGS. 3-5 was modeled using the conical ion volume geometry, other models were simulated using the straight-bore (constant inside diameter) geometry such as shown in FIG. 2 and produced similar results.

Figure 6:
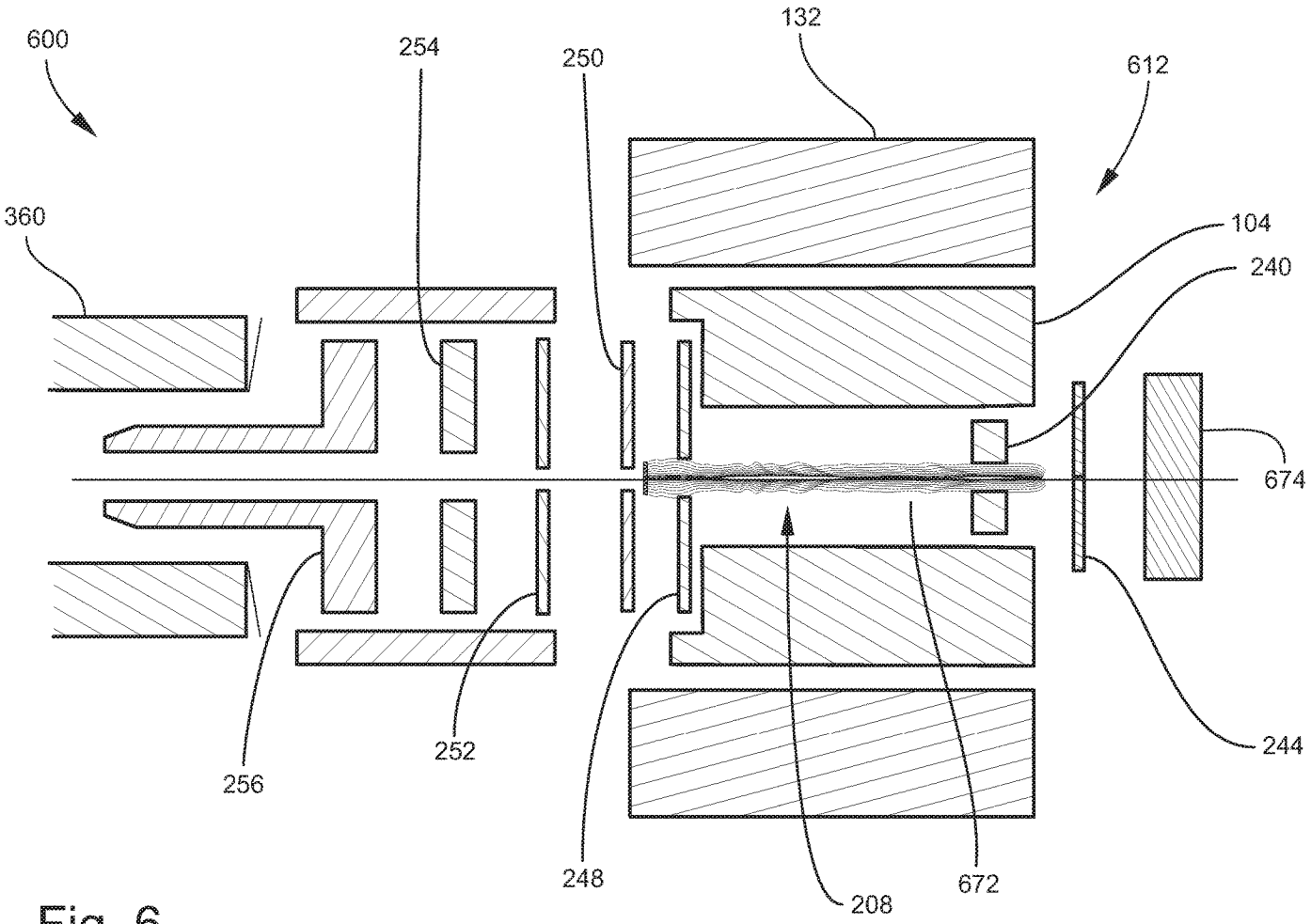
FIG. 6 is a model of another example of an ion source generated by ion simulation software according to an embodiment.

In another embodiment, the axial magnetic field may be modified to shape the electron beam and subsequently produced ion beam in a desired manner. This may be achieved, for example, by modifying the configuration of the magnet assembly. FIG. 6 is another model of an ion source 600 generated by ion simulation software, showing an axial electron beam 672 and a magnet assembly 612 according to another embodiment. In addition to magnets positioned radially relative to the source axis (radial magnets 132), the magnet assembly 612 includes a rear or on-axis magnet 674. The on-axis magnet 674 is positioned on the source axis outside the ionization chamber 208, on the side on the electron reflector 244 opposite to the ionization chamber 208. In this example, the on-axis magnet 674 is disk-shaped and the source axis passes through its center. With the addition of the on-axis magnet 674, the electron beam 672 is more focused at the electron source end and gradually expands or diverges in the direction of the lens assembly 120. Expanding the envelope of the electron beam 672 creates a larger ionization region, which may improve the ionization probability. This may be useful for addressing the adverse effects of space charge on the ionization process.

Figure 7:
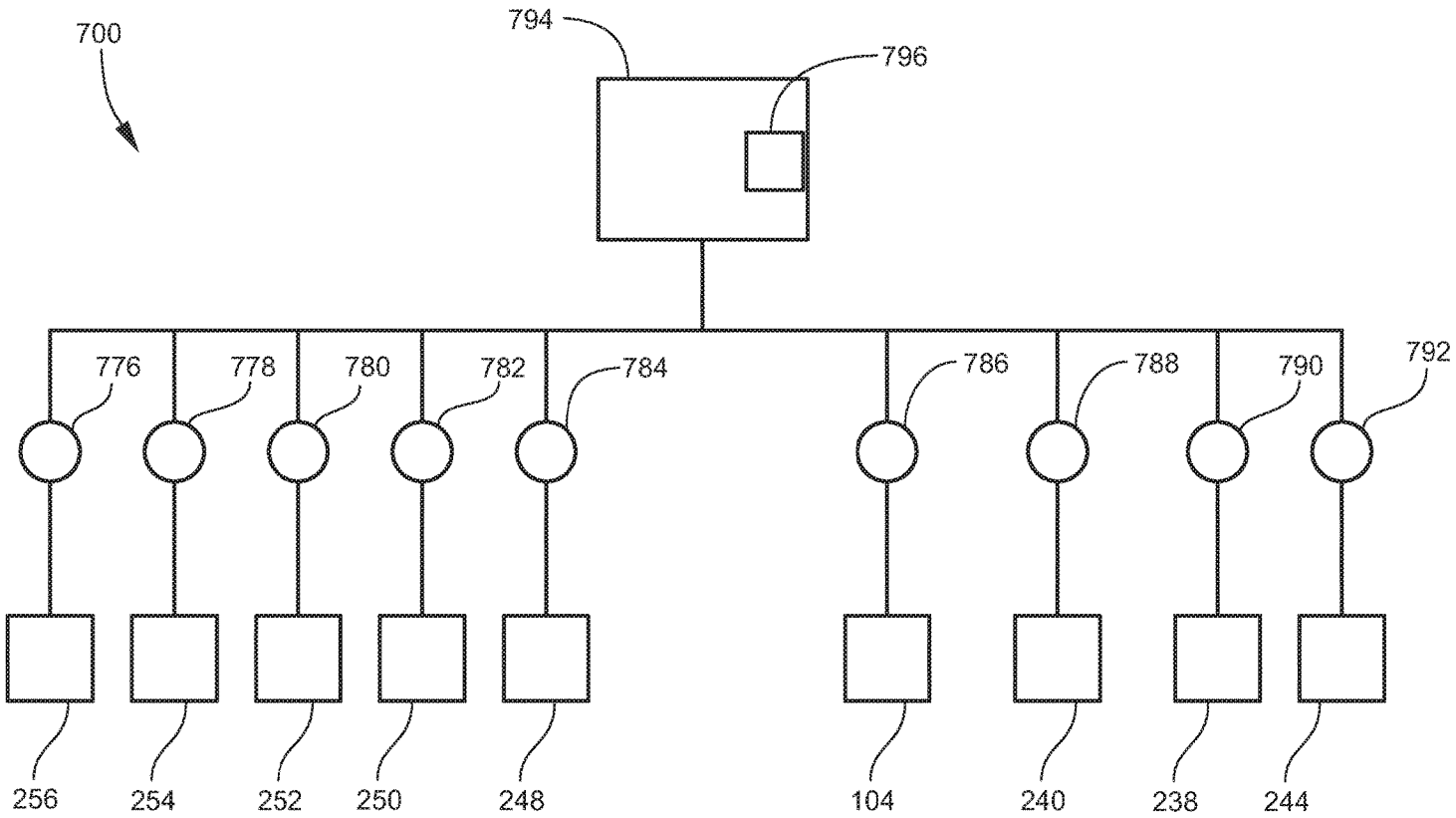
FIG. 7 is a schematic view of an example of hardware that may be provided with an ion source according to an embodiment.

FIG. 7 is a schematic view of an example of hardware or electronics 700 that may be provided with an ion source as disclosed herein. Individual voltages applied to various components of the ion source are depicted as respective voltage sources 776-792 (which may collectively be referred to herein as a power supply or voltage source). In some embodiments, one or more voltages may be applied by one or more of the respective voltage sources 776-792 to one or more conductive elements of the body 104. The voltage sources 776-792 are shown is being in signal communication with a controller 794 (e.g., an electronic processor-based controller or computer) to demonstrate that parameters of one or more of the voltage sources 776-792 may be controlled by the controller 794. The parameters may include, for example, settings and adjustments of voltage magnitudes; on/off states, timing and duration of applied voltages; coordination or synchronization of application of voltages by two or more of the voltage sources 776-792; etc. The controller 794 may include a computer-readable medium or software 796 for implementing programmed control of the voltage sources 776-792. In some embodiments the controller 794 may implement (e.g., utilizing firmware and/or software), in whole or in part, one or more of the methods disclosed herein.

In some embodiments, when initiating electron emission the "initial" electron energy may be set up as the potential difference between the thermionic cathode 238 and the ion repeller 240. This potential difference may be maintained at a desired fixed value as the voltage on the cathode 238 or ion repeller 240 changes, by adjusting the voltage on the other component. For example, the ion repeller 240 may be ramped and optimized while still maintaining proper electron energy offset, by adjusting the voltage on the cathode 238 such that it tracks the voltage on the electron reflector 244. Additionally, the voltage on the first lens element 250 may track the cathode voltage to optimize the electron reflecting function of the first lens element 250. The tracking functions may be implemented, for example, by the controller 794 schematically depicted in FIG. 7. As a default operation, the controller 794 may read the cathode voltage and apply the same value to the first lens element 250. To further allow for refinement in the optimization of the first lens element 250, an additional applied offset voltage may be ramped and summed in with the default applied cathode matching voltage, i.e., $V_{FIRST\ LENS\ ELEMENT}=V_{CATHODE}+V_{OFFSET}$. The application of the offset voltage may provide stronger reflection of electrons at the first lens element 250 to minimize incursion of the electrons into the ion trapping region between the first lens element 250 and the extractor 248, thereby further increasing the amount of the more viable high energy ions and reducing the amount of the undesirable low energy ions. Similarly, ramping electron energy varies the cathode voltage, and the voltage applied to the first lens element 250 may track the ramping cathode voltage as well.

In some applications, it may be desirable to reduce or eliminate the effects of electron space charge that develops in the ion source. For example, space charge effects may be significant enough to cause the electron beam to modulate uncontrollably thus adversely affecting the stability of the ion beam. To address this, in some embodiments a periodic voltage may be applied to one or more of the conductive elements of the electron source 116, lens assembly 120, and/or body 104. The periodic voltage may be a periodic DC pulse (with pulse width, period and amplitude empirically optimized) or a high-frequency (e.g., RF) potential. The periodic voltage may discharge any unwanted surface charge build up resulting from increasing levels of contamination. Alternatively, the electron beam may be gated to alleviate space charge build up, such as by employing appropriate electron optics to periodically deflect the electron beam away from the source axis. In some embodiments, space charge effects may be addressed by implementing techniques disclosed in U.S. Pat. No. 7,291,845, the entire content of which is incorporated by reference herein.

Figure 8:
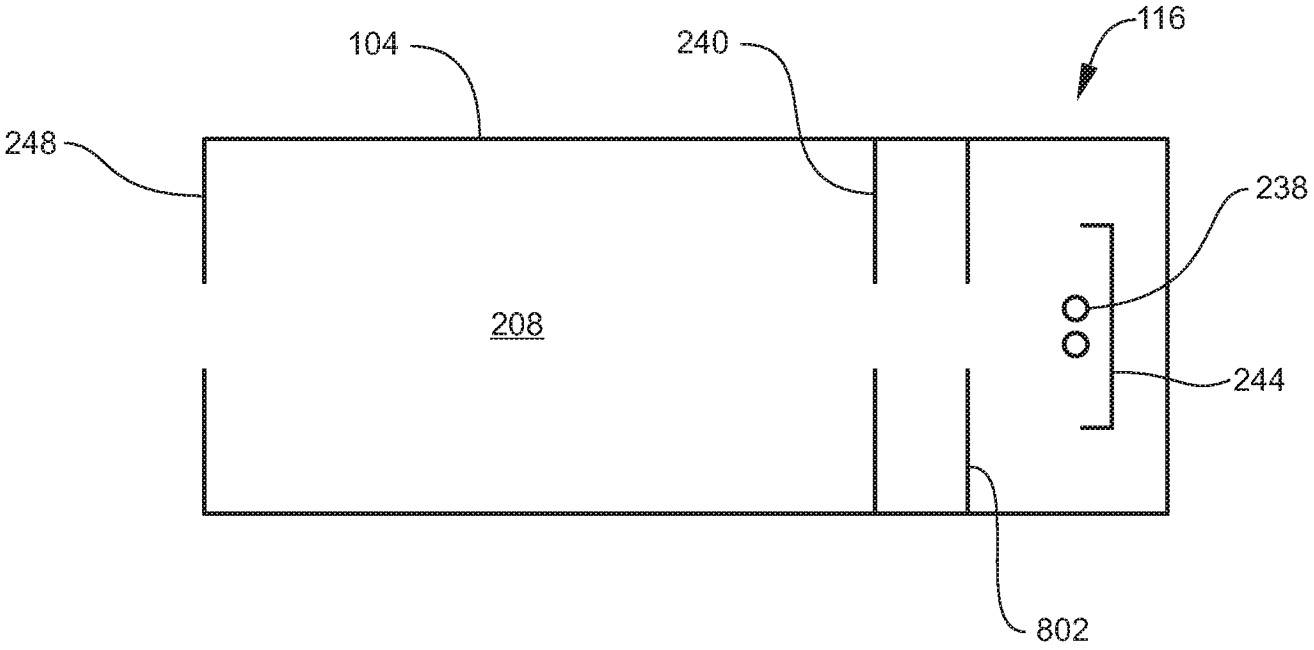
FIG. 8 is a schematic view of a portion of the ion source illustrated in FIGS. 1 and 2 according to another embodiment.

FIG. 8 is a schematic view of a portion of the ion source 100 illustrated in FIGS. 1 and 2 according to another embodiment. In this embodiment, an additional electrode (or electron extractor) 802 is added to the electron source 116 between the cathode (filament) 238 and the ion repeller 240.

By applying an appropriate voltage to the electron extractor 802, the electron extractor 802 may be utilized to tune the electric field conditions in the electron source 116, particularly when operating at low electron energy (e.g., 9 eV to 25 eV). For example, the electron extractor 802 may assist in drawing electrons away from the cathode 238 and toward the ionization chamber 208, and keeping the potential difference between the source body 104 and ion repeller 240 low.

Figure 9:
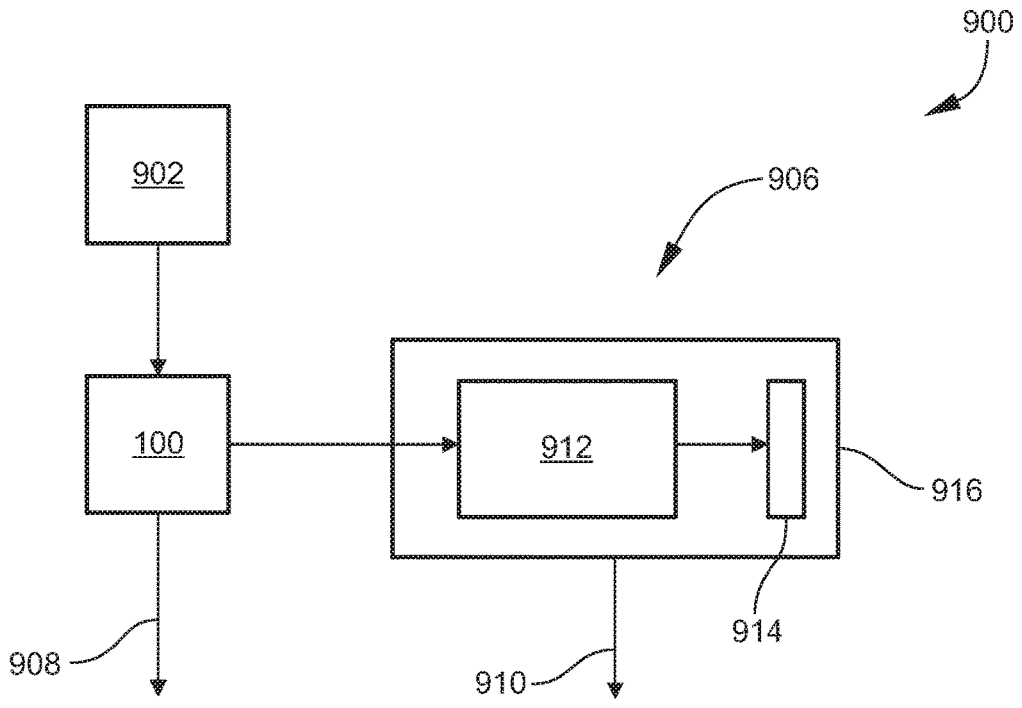
FIG. 9 is a schematic view of an example of a mass spectrometry (MS) system in which an ion source as disclosed herein may be provided.

FIG. 9 is a schematic view of an example of a mass spectrometry (MS) system 900 in which an ion source 100 as disclosed herein may be provided. The MS system 900 generally includes a sample source 902, the ion source 100, a mass spectrometer (MS) 906, and a vacuum system for maintaining the interiors of the ion source 100 and the MS 906 at controlled, sub-atmospheric pressure levels. The vacuum system is schematically depicted by vacuum lines 908 and 910 leading from the ion source 100 and the MS 906, respectively. The vacuum lines 908 and 910 are schematically representative of one or more vacuum-generating pumps and associated plumbing and other components appreciated by persons skilled in the art. It is also appreciated that one or more other types of ion processing devices (not shown) may be provided between the ion source 100 and the MS 906. The structure and operation of various types of sample sources, spectrometers, and associated components are generally understood by persons skilled in the art, and thus will be described only briefly as necessary for understanding the presently disclosed subject matter. In practice, the ion source 100 may be integrated with the MS 906 or otherwise considered as the front end or inlet of the MS 906, and thus in some embodiments may be considered as a component of the MS 906.

The sample source 902 may be any device or system for supplying a sample to be analyzed to the ion source 100. The sample may be provided in a gas-phase or vapor form that flows from the sample source 902 into the ion source 100. In hyphenated systems such as gas chromatography-mass spectrometry (GC-MS) systems, the sample source 902 may be a GC system, in which case an analytical column of the GC system is interfaced with the ion source 100 through suitable hardware.

The MS 906 may generally include a mass analyzer 912 and an ion detector 914 enclosed in a housing 916. The vacuum line 910 maintains the interior of the mass analyzer 912 at very low (vacuum) pressure. In some embodiments, the mass analyzer 912 pressure ranges from $10^{-4}$ to $10^{-9}$ Torr. The vacuum line 910 may also remove any residual non-analytical neutral molecules from the MS 906. The mass analyzer 912 may be any device configured for separating, sorting or filtering analyte ions on the basis of their respective m/z ratios. Examples of mass analyzers include, but are not limited to, multipole electrode structures (e.g., quadrupole mass filters, ion traps, etc.), time-of-flight (TOF) analyzers, and ion cyclotron resonance (ICR) traps. The mass analyzer 912 may include a system of more than one mass analyzer, particularly when ion fragmentation analysis is desired. As examples, the mass analyzer 912 may be a tandem MS or MS' system, as appreciated by persons skilled in the art. As another example, the mass analyzer 912 may include a mass filter followed by a collision cell, which in turn is followed by a mass filter (e.g., a triple-quad or QQQ system) or a TOF device (e.g., a qTOF system). The ion detector 914 may be any device configured for collecting and measuring the flux (or current) of mass-discriminated ions outputted from the mass analyzer 912. Examples of ion detectors 914 include, but are not limited to, electron multipliers, photomultipliers, and Faraday cups.

Axial EI sources as disclosed herein may in some embodiments be operated at either high electron energies or low electron energies. The energy of the electron beam may be adjusted by adjusting the voltage applied to the filament, thereby adjusting the current through the filament. In some embodiments, the electron beam may be adjusted over a range from 9 eV to 150 eV. Electron energies less than 70 eV, for example in a range from 9 eV to 25 eV, may be considered as being within the regime of soft ionization. Axial EI sources as disclosed herein are capable of effectively implementing EI over these ranges of electron energies. Even at very low energies, the EI sources are capable of producing an electron beam with an intensity and ionization yield sufficient for many experiments. These axial EI sources are thus able to implement hard ionization or soft ionization, and to switch between hard ionization and soft ionization (including during the same experiment), as desired or needed for optimizing the ionization and mass analysis processes for a given analyte or set of analytes. The axial EI sources may thus be employed in many cases in which conventionally EI is discarded in favor of a conventional soft ionization process such as chemical ionization (CI). Accordingly, axial EI sources as disclosed herein may be more universal ionization devices in comparison to other devices such as CI sources and conventional EI sources. For example, the axial EI source may be operated at a low electron energy that favors a desired ionization pathway, such as the formation of a molecular ion or other high mass ion. Methods relating to the operation of an axial EI source at low electron energies are disclosed in U.S. patent application Ser. No. 13/925,470, titled "ELECTRON IONIZATION (EI) UTILIZING DIFFERENT EI ENERGIES," filed on Jun. 24, 2013, the entire content of which is incorporated by reference herein.

Axial EI sources as disclosed herein may provide advantages over the widely used cross-beam, or Nier-type, EI source, in which the ion beam is generated in a direction orthogonal the electron beam. The Nier-type EI source is prone to loss of ions, due to a large number of ions being drawn out to the filaments or defocused and neutralized (lost) upon collision with the inner surfaces of the ionization chamber of the EI source. By contrast, an axial EI source as disclosed herein generates an on-axis electron beam, i.e., an electron beam that is coaxial with the resulting ion beam and with the downstream device into which the ions are transmitted such as, for example, a quadrupole mass filter. An axial electron beam may be much more likely to create ions that would have a much higher likelihood of success of being transferred into the downstream device from the EI source.

Figure 10A:
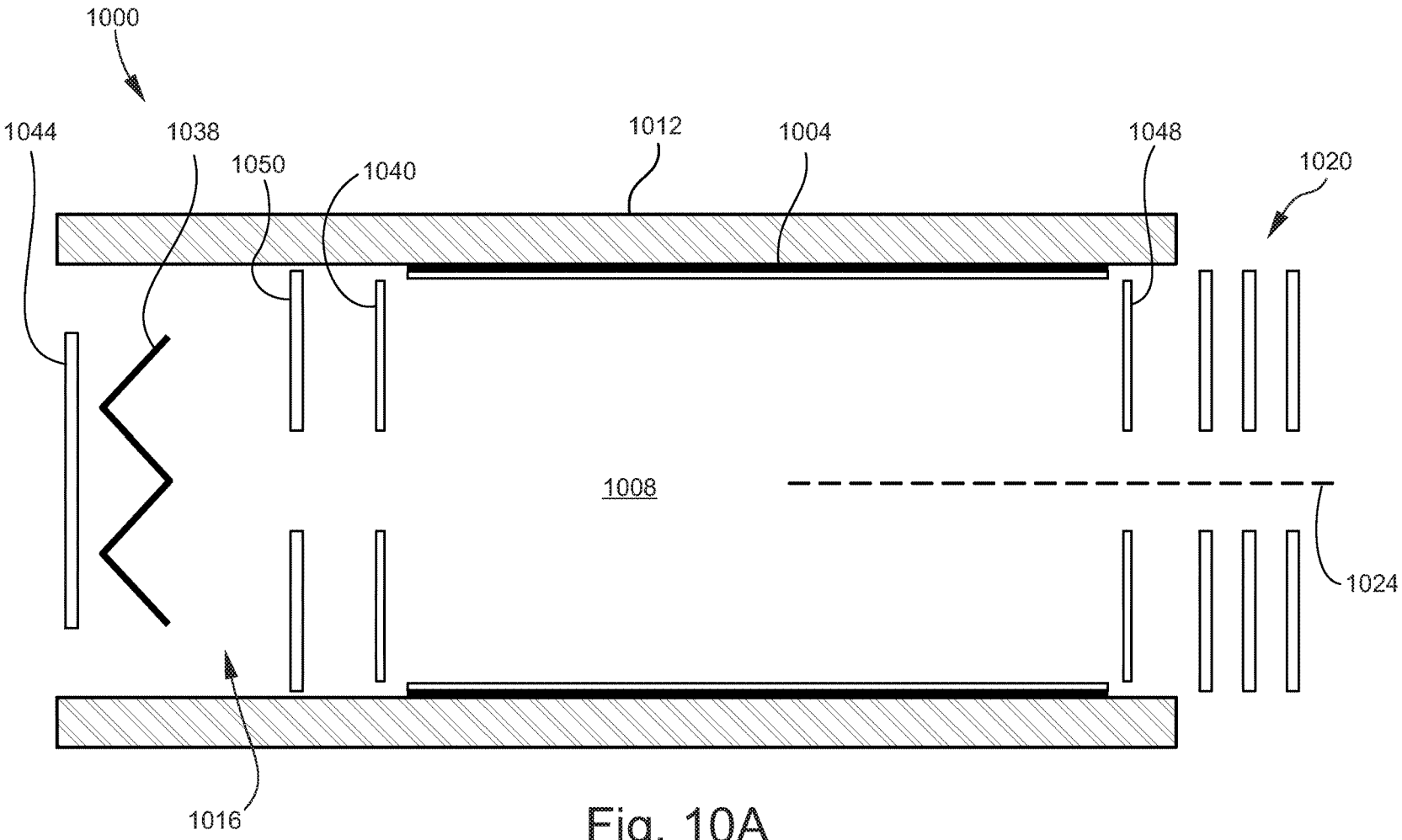
Fig. 10A Prior Art
FIG. 10A is a schematic cross-sectional side (lengthwise) view of a known EI ion source.

FIG. 10A is a schematic cross-sectional side (lengthwise) view of a known EI ion source 1000. The ion source 1000 generally includes a source body 1004 defining an internal ionization chamber 1008, a magnet assembly 1012 coaxially surrounding the source body 1004, an electron source 1016, and a lens assembly 1020. The ion source 1000 has an overall geometry or configuration generally arranged about a source axis 1024. The ionization chamber 1008 has a length along the source axis 1024 from a first end to a second end. A sample inlet (not shown) is formed through the source body 1004 at a suitable location to provide a path for directing sample material from a sample source into the ionization chamber 1008 where the sample material interacts with the electron beam. An ion repeller (electron extractor) 1040 is positioned at the first end, and generally is held at a voltage (potential) that draws electrons from the electron source 1016 into the ionization chamber 1008 and prevents ions from entering the electron source 1016. An ion extractor 1048 is positioned at the second end, and is held at a voltage (potential) that draws ions from the ionization chamber 1008 into the lens assembly 1020. The electron source 1016 includes a thermionic cathode 1038 such as a filament, which produces thermionic emission when heated by an electrical current as described above. The electron source 1016 also includes an electron repeller (or electron reflector) 1044 that helps to accelerate electrons in the direction of the ionization chamber 1008. The cathode 1038 is positioned between the electron repeller 1044 and the ion repeller 1040. The electron repeller 1044 and the cathode 1038 may be operated at equal potentials, or the electron reflector 1044 may be more negative than the cathode 1038 to assist in repelling electrons into the ionization chamber 1008. Voltages (potentials) are applied to the electron repeller 1044, ion repeller 1040, source body 1004, and ion extractor 1048 to establish an axial voltage gradient between the electron reflector 1044 and the lens assembly 1020. The voltage applied to the electron repeller 1044 is typically negative but more generally is less positive than the ion repeller 1040 and other downstream optics up to the first lens element of the lens assembly 1020. Some of the known EI ion sources may also include an additional electron lens 1050 between the cathode 1038 and the ion repeller 1040 that functions as an electron extractor along with the ion repeller 1040.

Figure 10B:
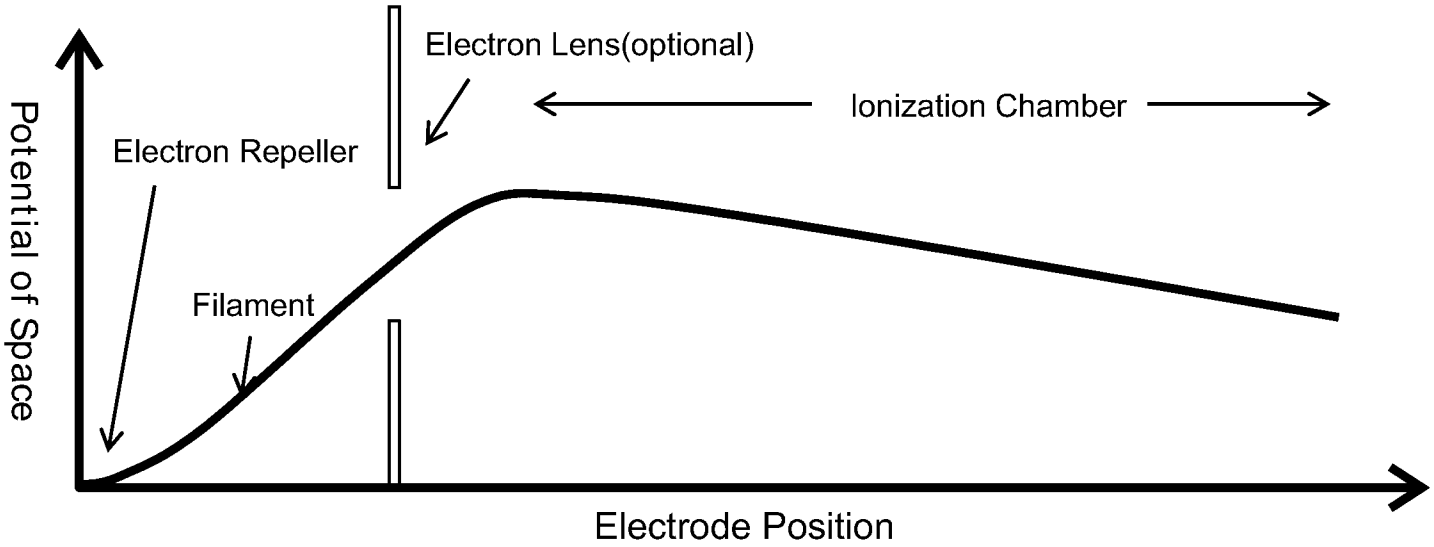
Fig. 10B Prior Art
FIG. 10B is a graph plotting the magnitude of the electric potential or "potential of space" (in volts) in the ion source illustrated in FIG. 10A as a function of axial position (or electrode position).

FIG. 10B is a graph plotting the magnitude of the electric potential or "potential of space" (in volts) in the ion source 1000 as a function of axial position (or electrode position). As shown, the voltages applied to the various electrodes of the conventional ion source 1000 are set such that the potential rises (becomes more positive) from the electron repeller 1044 to the entrance (e.g., ion repeller 1040, FIG. 10A) into the ionization chamber 1008. This is the case regardless of whether an additional electron lens 1050 is provided between the cathode 1038 (filament) and the ion repeller 1040. If the ion source 1000 is operated in the soft EI mode with an electron energy of about 20 eV or less, the resulting low electric field strength between the cathode 1038 and the ion repeller 1040 may not be able to generate a stable, high-intensity electron beam, and consequently the ion signal intensity may be unacceptably low.

To address this problem, embodiments of the present disclosure provide an EI ion source and method for soft EI that generate a stable and high-intensity low electron-energy electron beam. The high-intensity, low electron-energy electron beam results in higher sample signal and the production of a greater number of molecular ions and high-mass diagnostic ions, as compared to conventional EI ion sources. For example, the high-intensity, low electron-energy electron beam results in an improved ratio of molecular ions to fragment ions produced from a given sample. Instead of injecting electrons directly into the ionization chamber as in the conventional EI ion sources, an EI ion source of the present disclosure controls as-generated electrons such that they are first slowed down (in some embodiments, down to near zero velocity) by a potential valley (well) or plateau before entering ionization chamber. In this manner, a space-charge cloud develops around the potential valley space to form a "virtual cathode" characterized by a high density of electrons. From the virtual cathode, electrons are then accelerated into the ionization chamber as a high-intensity electron beam. The intensity of the electron beam may be significantly higher than that attainable by conventional ion sources operating at low electron energy. The higher intensity electron beam of the ion source of the present disclosure raises the intensity of sample signals and improves soft EI performance, thereby facilitating structural elucidation, chemical identification, and tandem MS (MS/MS) or related consecutive fragmentation experiments. Furthermore, the electron energy of the soft EI ion source of the present disclosure may be programmed to produce the most favorable ions intended by a given experiment.

Figure 11A:
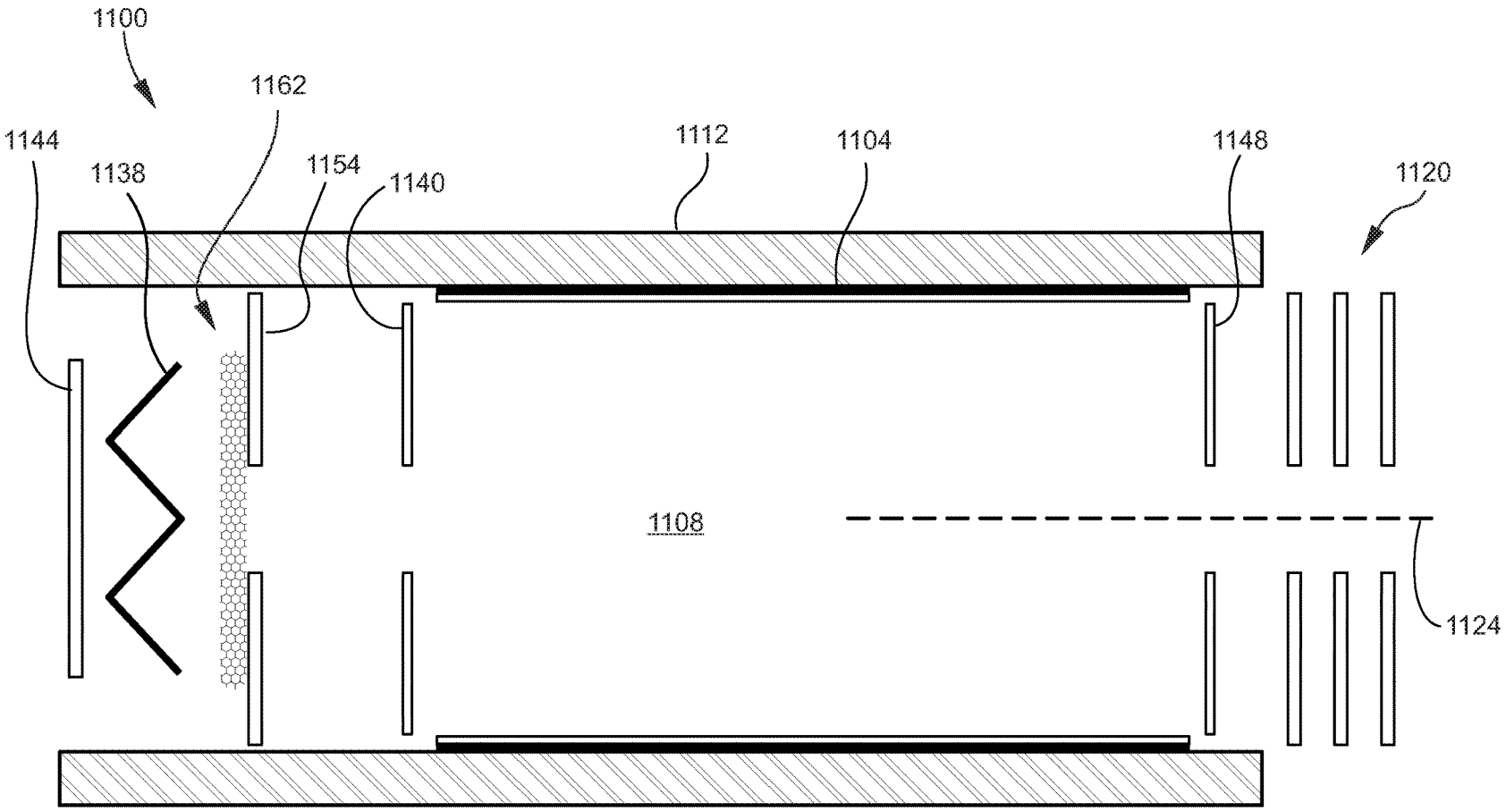
FIG. 11A is a schematic cross-sectional side (lengthwise) view of an example of an EI ion source configured for soft EI according to an embodiment of the present disclosure.

FIG. 11A is a schematic cross-sectional side (lengthwise) view of an example of an EI ion source 1100 configured for soft EI according to an embodiment of the present disclosure. The ion source 1100 generally includes a source body 1104 defining an internal ionization chamber 1108, a magnet assembly 1112, an electron source 1116, and a lens assembly 1120. The ionization chamber 1108 generally includes an electron inlet or entrance communicating with the electron source 1116, and an ion outlet or exit that may communicate with a downstream device such as described elsewhere in the present disclosure.

In operation, the electron source 1116 produces an electron beam and transmits it into the ionization chamber 1108 via the electron inlet, and a stream of sample material to be ionized is admitted into the ionization chamber 1108 where the sample material encounters the electron beam. The ion source 1100 subsequently produces ions from the sample material and focuses the ions into an ion beam along a source axis 1124. The ions exit the ion source 1100 along the source axis 1124 via the ion outlet and enter the next ion processing device, which may have an ion entrance along the source axis 1124. In some embodiments and as illustrated in FIG. 11A, the ion source 1100 may be an axial ion source as in the case of other embodiments described above. In such embodiments, the ion source 1100 may have an overall geometry or configuration generally arranged about the source axis 1124. In this case, the electron inlet as well as the ion inlet are located on the source axis 1124, and the ion source 1100 produces the electron beam along the source axis 1124.

The ionization chamber 1108 has a length along the source axis 1124 from a first end to a second end. In the case of an axial ion source geometry, the electron inlet may be located at the first end and the ion outlet may be located at the second end. A sample inlet (not shown) is formed through the source body 1104 at a suitable location to provide a path for directing sample material from a sample source into the ionization chamber 1108 where the sample material interacts with the electron beam. An ion repeller (electron extractor) 1140 is positioned at the first end, and is held at a voltage that draws electrons from the electron source 1116 into the ionization chamber 1108 and prevents ions from entering the electron source 1116. An ion extractor 1148 is positioned at the second end, and is held at a voltage that draws ions from the ionization chamber 1108 into the lens assembly 1120. In the illustrated example of axial geometry, the ion repeller 1140 and the ion extractor 1148 may be considered as being the axial first and second ends, respectively, of the ionization chamber 1108, and further may be considered as corresponding to the electron inlet and ion outlet, respectively.

The magnet assembly 1112 may coaxially surround the source body 1104. The magnet assembly 1112 may be configured for generating a uniform axial magnetic field in the ionization chamber 1108 to focus and compress the electron beam and the resulting ion beam along the source axis 1124. The magnet assembly 1112 may be configured according to other embodiments described herein.

The lens assembly 1120 is positioned at the second end of the ionization chamber 1108, axially opposite to the electron source 1116. The lens assembly 1120 generally may be configured for directing an ion beam out from the ionization chamber 1108 along the source axis 1124 and into the next ion processing device. For this purpose, the lens assembly 1120 may include a plurality of lens elements (or electrodes) independently addressable by voltage sources. Each lens element may have an aperture or slot on the source axis 1124. The lens assembly 1120 may be configured, and voltages applied to its lens elements, according to other embodiments described herein. Thus, the lens elements may serve various functions such as, for example, ion extraction, ion beam focusing, electron reflection, etc. The last lens element of the lens assembly 1120 (e.g., an exit lens element) may be configured or also serve as the entrance lens element into an ion processing device.

The electron source 1116 includes a thermionic cathode 1138 such as a filament, which produces thermionic emission when heated by an electrical current as described above. The electron source 1116 also includes an electron repeller (or electron reflector) 1144 that helps to accelerate electrons in the direction of the ionization chamber 1108. The cathode 1138 is positioned between the electron reflector 1144 and the ion repeller 1140. The electron reflector 1144 and the cathode 1138 may be operated at equal potentials (and in some embodiments may be electrically interconnected), or the electron reflector 1144 may be more negative than the cathode 1138 to assist in repelling electrons into the ionization chamber 1108. The electron source 1116 further includes one or more electron lenses between the cathode 1138 and the ion repeller 1140, such as an electron lens 1154, as described further below. Generally, such electron lenses may have any configuration capable of being energized by a voltage source and providing an axial path for electrons from the cathode 1138 toward the ionization chamber 1108. As examples, the electron lens may be a plate having an aperture on-axis or a pair of plates separated by a gap or slot on-axis.

Figure 11B:
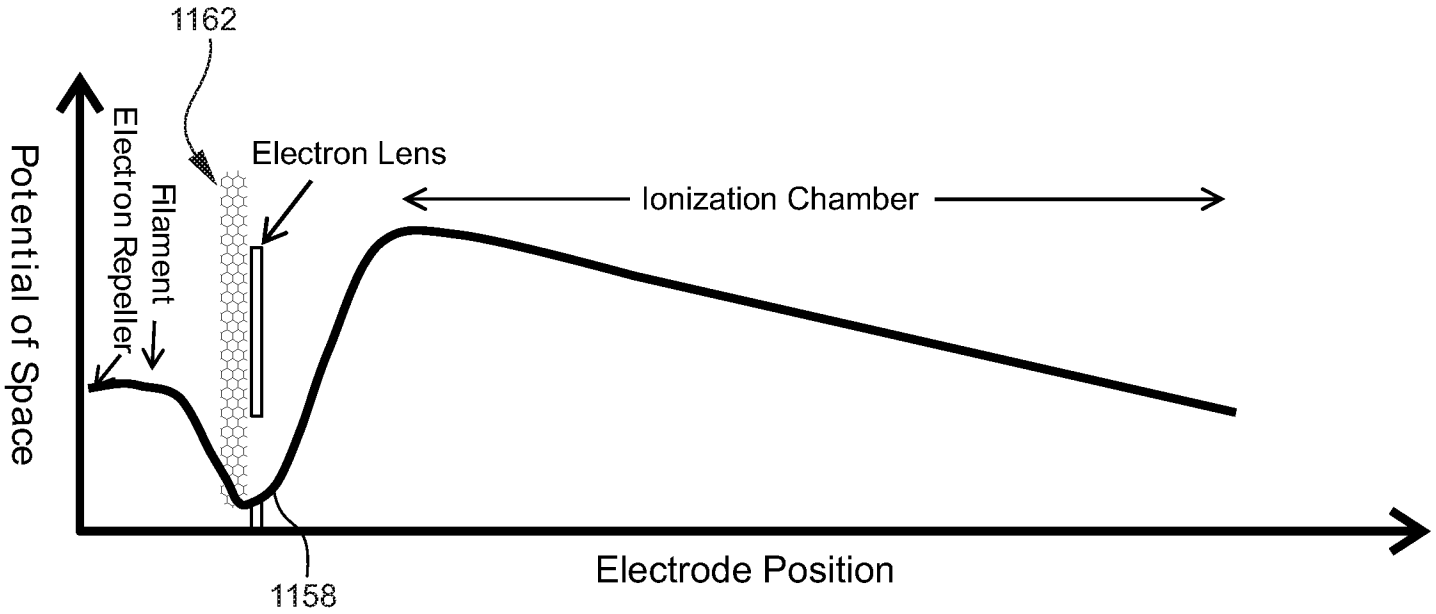
FIG. 11B is a graph plotting the magnitude of the electric potential or "potential of space" (in volts) in the ion source illustrated in FIG. 11A as a function of axial position (or electrode position).

FIG. 11B is a graph plotting the magnitude of the electric potential or "potential of space" (in volts) in the ion source 1100 as a function of axial position (or electrode position). As shown, respective voltages are applied to the electron repeller 1144, the electron lens 1154, an appropriately positioned electron extractor such as the ion repeller 1140 and/or the source body 1104, and the ion extractor 1148 to establish an overall axial voltage gradient between the electron repeller 1144 and the lens assembly 1120. However, the magnitude of the voltage applied to the electron lens 1154 is lower (less positive) than the voltage applied to the ion repeller 1140, or lower (less positive) than both of the voltages applied to the thermionic cathode 1138 (and electron repeller 1144) and the ion repeller 1140. As shown in FIG. 11B, this voltage programming creates a potential valley or well 1158 at the electron lens 1154. In the present context, the term "at" or "around" encompasses, and is used interchangeably with, the phrase "in the vicinity of." Consequently, electrons emitted from the thermionic cathode 1138 are initially accelerated toward the ionization chamber 1108, but then encounter the potential valley 1158 where the electrons rapidly lose kinetic energy and slow down, i.e., the potential valley 1158 decelerates the electrons. In some embodiments, the potential valley 1158 may have a size (magnitude difference) and shape or profile that causes the electrons to slow down to near zero velocity. The potential valley 1158 in turn causes the rapid development of a virtual cathode 1162 at (in the vicinity of) the electron lens 1154. As such, the electron lens 1154 may also be referred to as a virtual cathode-generating lens. The virtual cathode 1162 may be characterized as a high-density accumulation of electrons decelerated in the potential valley 1158. The virtual cathode 1162 may also be characterized as operating in combination with the thermionic cathode 1138 as an enhanced source of electrons for the electron beam that is transmitted into the ionization chamber 1108. In the present context, an "electron extractor" is any conductive element that is configured and positioned for accelerating electrons into the ionization chamber 1108 when an appropriate potential is applied to the "electron extractor." Thus, in the present embodiment, the ion repeller 1140 functions as an electron extractor (as well as preventing ions from passing into the electron source 1116 from the ionization chamber 1108, as noted above). In some embodiments, the source body 1104 may also be considered as an electron extractor.

After slowing down and accumulating at the virtual cathode 1162, electrons are accelerated from the virtual cathode 1162 into the ionization chamber 1108 under the influence of the potential difference between the electron lens 1154 and the ion repeller 1140. The space-charge conditions associated with the virtual cathode 1162 may also contribute to the acceleration of the electrons into the ionization chamber 1108 via repulsion. Due to the generation of the high-intensity virtual cathode 1162, the electron beam entering the ionization chamber 1108 is a stable, high-intensity electron beam, even when the ion source 1100 is set to operate at a low electron energy required for soft EI.

As one non-limiting example, the voltage magnitudes applied to the electrodes of the ion source 1100 may be as follows: 28 V on the thermionic cathode 1138 (for an electron ionization energy of 12 eV), 26 V on the electron lens 1154, 45 V on the ion repeller 1140, 40 V on the source body 1104, and 38 V on the ion extractor 1148. As noted above, the voltage on the electron repeller 1144 may be the same or different than the voltage on the thermionic cathode 1138. In the present example, all voltage magnitudes are positive values, but in other examples one or more of the voltages may be negative values.

Figure 12A:
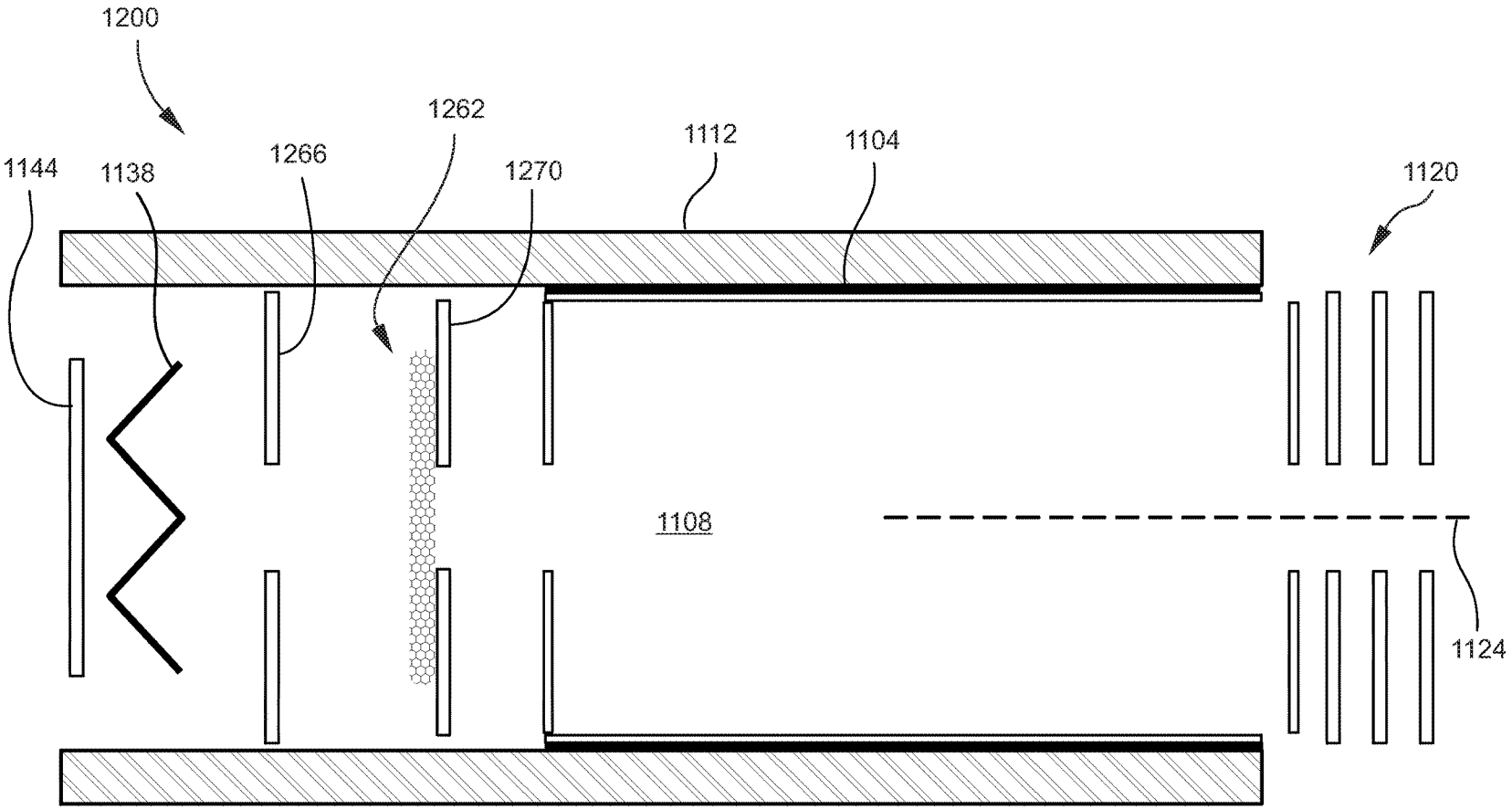
FIG. 12A is a schematic cross-sectional side (lengthwise) view of an example of an EI ion source configured for soft EI according to another embodiment of the present disclosure.
Figure 12B:
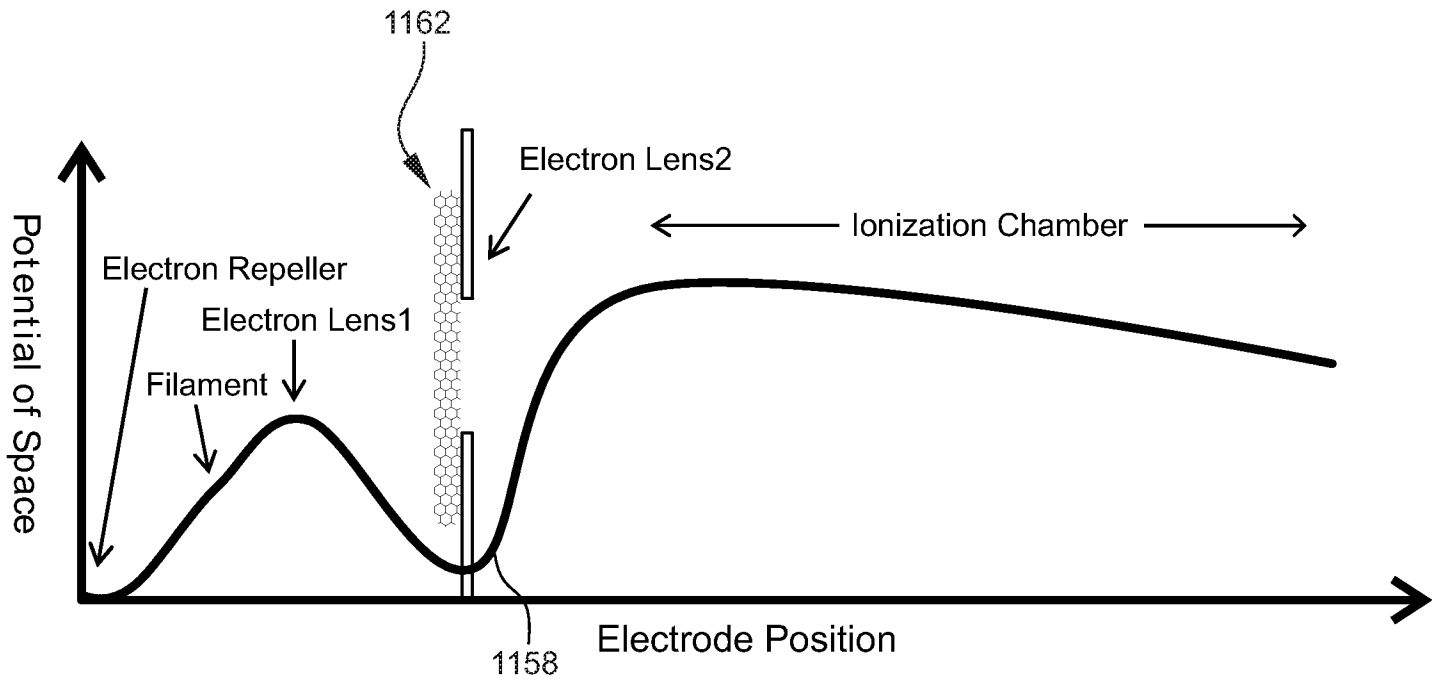
FIG. 12B is a graph plotting the magnitude of the electric potential or "potential of space" (in volts) in the ion source illustrated in FIG. 12B as a function of axial position (or electrode position).

FIG. 12A is a schematic cross-sectional side (lengthwise) view of an example of an EI ion source 1200 configured for soft EI according to another embodiment of the present disclosure. FIG. 12B is a graph plotting the magnitude of the electric potential or "potential of space" (in volts) in the ion source 1200 as a function of axial position (or electrode position), similar to FIG. 11B. The configuration of the ion source 1200 may be generally similar to that of the ion source 1100 described above and illustrated in FIGS. 11A and 11B. Accordingly, in FIGS. 12A and 12B the same or similar reference numerals designate the same or similar features shown in FIGS. 11A and 11B. Referring to FIG. 12A, the ion source 1200 includes two electron lenses between the cathode 1138 and the ion repeller 1140, a first electron lens 1266 and a second electron lens 1270. The first electron lens 1266 is positioned axially between the thermionic cathode 1138 and the second electron lens 1270, and the second electron lens 1270 is positioned axially between the first electron lens 1266 and the ion repeller 1140. Referring also to FIG. 12B, the potential on the first electron lens 1266 may be higher (more positive) than the potential on the thermionic cathode 1138, while the potential on the second electron lens 1270 is lower (less positive) than the potential on the first electron lens 1266 (and may also be lower than the potential on the thermionic cathode 1138). This configuration results in the potential valley 1158 and attendant virtual cathode 1262 being located at (in the vicinity of) the second electron lens 1270. As such, the second electron lens 1270 may also be referred to as a virtual cathode-generating lens. This configuration may be desirable for positioning the virtual cathode 1262 at a greater axial distance from the thermionic cathode 1138, as compared to the configuration shown in FIGS. 11A and 11B. In this case, adding the first electron lens 1266 and applying a higher potential to first electron lens 1266 than to the thermionic cathode 1138 may facilitate accelerating electrons from the thermionic cathode 1138 to the second electron lens 1270 over the increased axial distance. The increased axial distance may be desirable for preventing space-charge effects associated with the virtual cathode 1262 from impairing thermionic emission from the thermionic cathode 1138.

Figure 13A:
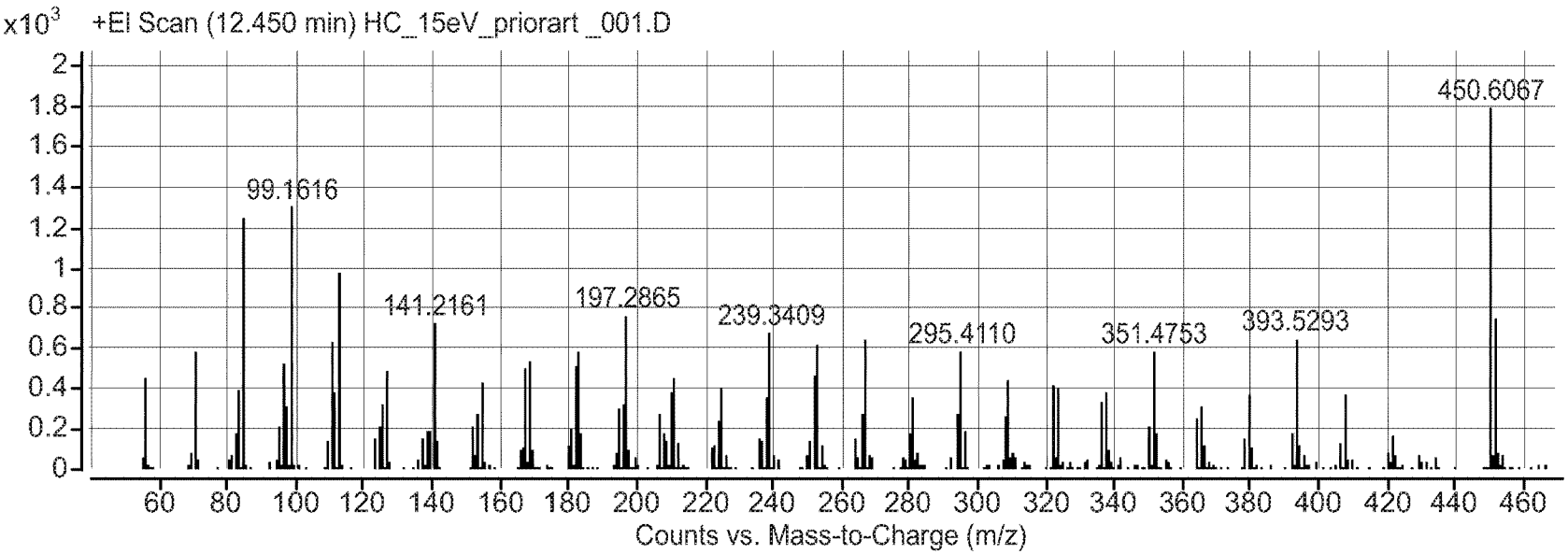
FIG. 13A is a mass spectrum of the compound N-Dotriacontane as measured by a mass spectrometer that included a conventional ion source having a configuration consistent with the ion source illustrated in FIGS. 10A and 10B.
Figure 13B:
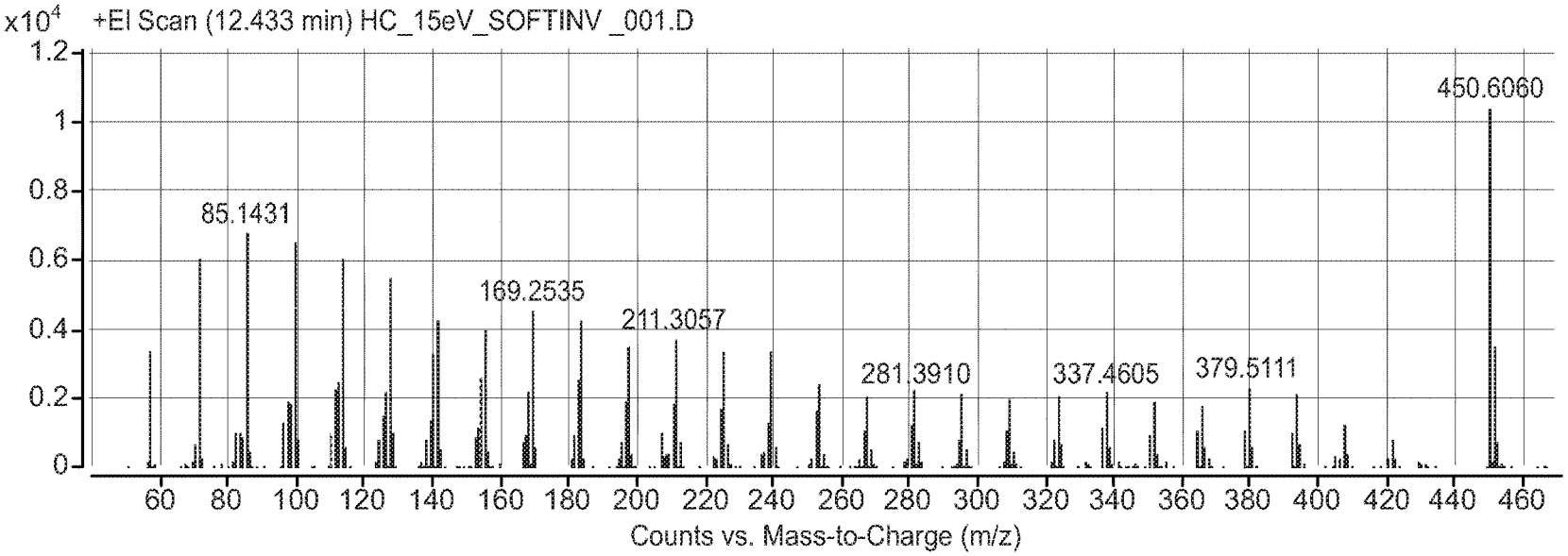
FIG. 13B is a mass spectrum of the same compound N-Dotriacontane as measured by the same mass spectrometer as pertains to FIG. 13A, but utilizing an ion source having a configuration consistent with the ion sources illustrated in FIGS. 11A to 12B.

FIG. 13A is a mass spectrum of the compound N-Dotriacontane as measured by a mass spectrometer that included a conventional ion source having a configuration consistent with the ion source 1000 described above and illustrated in FIGS. 10A and 10B. The electron energy was set to 15 eV. As shown, the abundance of the molecular ion (m/z=450.6) is about $1.8\times10^3$ (ion signal intensity). By comparison, FIG. 13B is a mass spectrum of the same compound N-Dotriacontane as measured by the same mass spectrometer, but utilizing an ion source having a configuration consistent with the ion sources 1100 and 1200 described above and illustrated in FIGS. 11A to 12B, and thus operating with a potential valley and virtual cathode. The electron energy was again set to 15 eV. As shown, the abundance of the molecular ion is over $1\times10^4$. Hence, in this example the stable, high-intensity electron beam produced by the ion source disclosed herein generated over five times the number of molecular ions generated by the conventional ion source, ionizing the same compound and at the same electron energy and other operating conditions.

In some embodiments, hardware or electronics similar to that described above and illustrated in FIG. 7 may be provided with the ion source 1100 or 1200. Individual voltages may be applied to various components of the ion source 1100 or 1200, such as the electron repeller 1144, thermionic cathode 1138, electron lens 1154 of ion source 1100 or first electron lens 1266 and second electron lens 1270 of ion source 1200, ion repeller 1140, source body 1104, ion extractor 1148, and electrodes/lens elements of the lens assembly 1120. As described above, the voltages may be applied by voltage sources that communicate with a controller 794 (e.g., an electronic processor-based controller, computing device, computer, etc.). Thus, the controller 794 may be configured to control the operating parameters of one or more of voltage sources such as, for example, settings and adjustments of voltage magnitudes, on/off states, timing and duration of applied voltages, coordination or synchronization of application of voltages to two or more of the voltage sources, etc. The controller 794 may include a computer-readable medium or software 796 for implementing programmed control of the voltage sources. In some embodiments the controller 794 may implement (e.g., utilizing firmware and/or software), in whole or in part, one or more of the methods disclosed herein.

In some embodiments a mass spectrometer (MS), or mass spectrometry (MS) system, is provided that includes an ion source configured in the manner of the ion source 1100 or 1200 described above and illustrated in FIGS. 11A to 12B. A representative example of such an MS system is the MS system 900 described above and illustrated in FIG. 9. In this case, the ion source 100 in FIG. 9 corresponds to the ion source 1100 or 1200. The MS system 900 may also include the controller 794, computer-readable medium or software 796, and other hardware or electronics described above in conjunction with FIG. 7.

Embodiments of ion sources 1100 and 1200 described above and illustrated in FIGS. 11A to 12B have been described primarily in the context of an axial ion source configuration. It will be understood, however, that the subject matter disclosed herein may also be applied to other embodiments in which the electron beam is orthogonal to the ion beam instead of both beams being aligned on the same axis. For example, the electron inlet and associated electrodes or lenses may be oriented orthogonal to the source axis 1124, while the ion outlet and associated electrodes or lenses are oriented on the source axis 1124.

It will also be understood that while examples of the ion source are described above primarily in the context of EI, the ion sources taught herein may additionally or alternatively be configured for chemical ionization (CI), which is a well-known technique that also utilizes an electron beam. In the case of CI, the ion source may include an inlet for admitting a reagent gas into the ionization chamber.

Exemplary Embodiments

Exemplary embodiments provided in accordance with the presently disclosed subject matter include, but are not limited to, the following:

1. An ion source, comprising: a body surrounding an ionization chamber; an electron extractor configured for accelerating electrons into the ionization chamber; an electron source outside the ionization chamber and comprising an electron repeller, a thermionic cathode, and an electron lens between the thermionic cathode and the electron extractor; and a voltage source configured for: applying respective voltages to the electron repeller, the thermionic cathode, the electron lens, and the electron extractor effective for: emitting electrons from the thermionic cathode; accelerating the electrons toward the ionization chamber; and generating a potential valley at the electron lens effective for decelerating the electrons and forming at the electron lens a virtual cathode comprising the decelerated electrons.

2. The ion source of embodiment 1, comprising a sample inlet leading into the ionization chamber.

3. The ion source of embodiment 1 or 2, comprising a magnet assembly surrounding the body and configured for generating an axial magnetic field in the ionization chamber.

4. The ion source of any of embodiments 1 to 3, wherein the ionization chamber comprises an ion outlet oriented orthogonally to the electron extractor.

5. The ion source of any of embodiments 1 to 3, wherein the ionization chamber comprises an ion outlet aligned with the electron extractor along an axis.

6. The ion source of any of the preceding embodiments, wherein the ionization chamber comprises an ion extractor configured for directing an ion beam out from the ionization chamber.

7. The ion source of any of embodiments 1 to 6, wherein the thermionic cathode is positioned between the electron repeller and the electron extractor.

8. The ion source of any of embodiments 1 to 6, wherein the thermionic cathode is oriented orthogonally to the electron repeller.

9. The ion source of any of the preceding embodiments, wherein the voltage source is configured for decelerating the electrons to near zero velocity in the potential valley.

10. The ion source of any of the preceding embodiments, wherein the electron lens comprises a first electron lens between the thermionic cathode and the electron extractor, and a second electron lens between the first electron lens and the electron extractor, and wherein the voltage source is configured for applying respective voltages to the first electron lens and the second electron lens effective for: accelerating the electrons from the thermionic cathode toward the second electron lens; and generating the potential valley and forming the virtual cathode at the second electron lens.

11. The ion source of any of the preceding embodiments, wherein the electron extractor comprises an ion repeller, the body, or both an ion repeller and the body 12. The ion source of any of the preceding embodiments, comprising a controller configured for controlling the voltage source.

13. A mass spectrometer (MS), comprising: the ion source of any of the preceding embodiments; and a mass analyzer downstream from the ionization chamber.

14. The MS of embodiment 13, comprising a controller configured for controlling the voltage source.

15. A method for producing an electron beam for electron ionization, the method comprising: producing electrons; accelerating the electrons toward an ionization chamber; decelerating the electrons to a level effective for forming a virtual cathode outside of the ionization chamber, the virtual cathode comprising the decelerated electrons; and accelerating the electrons from the virtual cathode into the ionization chamber.

16. The method of embodiment 15, comprising producing the electrons at an electron energy of about 20 eV or lower.

17. The method of embodiment 15 or 16, wherein producing the electrons comprises emitting the electrons from a thermionic cathode.

18. The method of any of embodiments 15 to 17, comprising decelerating the electrons to near zero velocity at a region where the virtual cathode is formed.

19. The method of any of embodiments 15 to 18, wherein accelerating the electrons toward the ionization chamber comprises applying a voltage to an electron extractor, and decelerating the electrons comprises applying a voltage to an electron lens of lesser magnitude than the voltage applied to the electron extractor, and wherein the virtual cathode is formed at the electron lens.

20. The method of claim 19, wherein producing the electrons comprises applying a voltage to a thermionic cathode, and wherein the voltage applied to the electron lens is of lesser magnitude than the voltage applied to the thermionic cathode.

21. The method of embodiment 19 or 20, comprising operating a controller to control the voltages applied to the electron extractor and the electron lens.

22. The method of any of embodiments 15 to 21, wherein the electron extractor comprises an ion repeller, the body, or both an ion repeller and the body.

23. The method of any of embodiments 15 to 22, wherein accelerating the electrons toward the ionization chamber comprises applying respective voltages to a first electron lens and an electron extractor, and decelerating the electrons comprises applying a voltage to a second electron lens between the first electron lens and electron extractor, and wherein the voltage applied to the second electron lens is of lesser magnitude than the voltage applied to the electron extractor and the virtual cathode is formed at the second electron lens.

24. The method of embodiment 23, wherein the voltage applied to the second electron lens is of lesser magnitude than the voltage applied to the first electron lens.

25. The method of embodiment 23 or 24, wherein producing the electrons comprises applying a voltage to a thermionic cathode, and wherein the voltage applied to the first electron lens is of greater magnitude than the voltage applied to the thermionic cathode.

26. The method of any of embodiments 15 to 24, comprising focusing the electrons as a beam along an axis of the ionization chamber by applying an axial magnetic field to the ionization chamber.

27. The method of embodiment 26, comprising producing ions by directing a sample material into the ionization chamber toward the electrons, wherein applying the axial magnetic field focuses the ions as a beam along the axis.

28. The method of any of embodiments 15 to 27, comprising producing ions by directing a sample material into the ionization chamber toward the electrons.

29. The method of embodiment 28, wherein the electrons are accelerated into the ionization chamber as an electron beam along an axis, and further comprising focusing the ions as an ion beam along the axis.

30. The method of embodiment 28, wherein the electrons are accelerated into the ionization chamber as an electron beam, and further comprising focusing the ions as an ion beam orthogonal to the electron beam.

31. The method of any of embodiments 28 to 30, comprising transmitting the ions from the ionization chamber to a downstream device.

32. A method for analyzing sample material, the method comprising: producing an electron beam according to the method of any of embodiments 15 to 31; producing ions by directing sample material into the ionization chamber toward the electrons; and transmitting the ions from the ionization chamber to a mass analyzer.

33. The method of embodiment 32, comprising measuring respective abundances of ions processed by the mass analyzer according to a spectrum of mass-to-charge ratios.

It will be understood that the system controller 794 schematically depicted in FIG. 7 may represent one or more modules configured for controlling, monitoring, timing, synchronizing and/or coordinating various functional aspects of the ion source. The system controller 794 may also represent one or more modules configured for controlling functions or components of an associated spectrometry system, including, for example, receiving the ion measurement signals and performing other tasks relating to data acquisition and signal analysis as necessary to generate a mass spectrum characterizing the sample under analysis.

For all such purposes, the controller 794 may include a computer-readable medium that includes instructions for performing any of the methods disclosed herein. The controller 794 is schematically illustrated as being in signal communication with various components of the ion source via wired or wireless communication links. Also for these purposes, the controller 794 may include one or more types of hardware, firmware and/or software, as well as one or more memories and databases. The controller 794 typically includes a main electronic processor providing overall control, and may include one or more electronic processors configured for dedicated control operations or specific signal processing tasks. The system controller 794 may also schematically represent all voltage sources not specifically shown, as well as timing controllers, clocks, frequency/waveform generators and the like as needed for applying voltages to various components. The controller 794 may also be representative of one or more types of user interface devices, such as user input devices (e.g., keypad, touch screen, mouse, and the like), user output devices (e.g., display screen, printer, visual indicators or alerts, audible indicators or alerts, and the like), a graphical user interface (GUI) controlled by software, and devices for loading media readable by the electronic processor (e.g., logic instructions embodied in software, data, and the like). The controller 794 may include an operating system (e.g., Microsoft Windows® software) for controlling and managing various functions of the controller 794.

It will be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion source, comprising:

a body surrounding an ionization chamber;

an electron extractor configured for accelerating electrons into the ionization chamber;

an electron source outside the ionization chamber and comprising an electron repeller, a thermionic cathode, and an electron lens between the thermionic cathode and the electron extractor; and a voltage source configured for applying respective voltages to the electron repeller, the thermionic cathode, the electron lens, and the electron extractor effective for:

emitting electrons from the thermionic cathode;

initially accelerating the electrons toward the ionization chamber;

generating a potential valley at the electron lens effective for decelerating the electrons that were initially accelerated and forming at the electron lens a virtual cathode comprising the decelerated electrons; and accelerating the previously decelerated electrons as an electron beam from the virtual cathode into the ionization chamber.

2. The ion source of claim 1, comprising a sample inlet leading into the ionization chamber.

3. The ion source of claim 1, comprising a magnet assembly surrounding the body and configured for generating an axial magnetic field in the ionization chamber.

4. The ion source of claim 1, wherein the ionization chamber comprises an ion outlet oriented orthogonally to the electron extractor, or aligned with the electron extractor along an axis.

5. The ion source of claim 1, wherein the ionization chamber comprises an ion extractor configured for directing an ion beam out from the ionization chamber.

6. The ion source of claim 1, wherein the thermionic cathode has a configuration selected from the group consisting of: the thermionic cathode is positioned between the electron repeller and the electron extractor; the thermionic cathode is oriented orthogonally to the electron repeller; and both of the foregoing.

7. The ion source of claim 1, wherein the voltage source is configured for decelerating the electrons to near zero velocity in the potential valley.

8. The ion source of claim 1, wherein the electron lens comprises a first electron lens between the thermionic cathode and the electron extractor, and a second electron lens between the first electron lens and the electron extractor, and wherein the voltage source is configured for applying respective voltages to the first electron lens and the second electron lens effective for:

accelerating the electrons from the thermionic cathode toward the second electron lens; and generating the potential valley and forming the virtual cathode at the second electron lens.

9. The ion source of claim 1, wherein the electron extractor comprises an ion repeller, the body, or both an ion repeller and the body.

10. A mass spectrometer (MS), comprising:

the ion source of claim 1; and a mass analyzer downstream from the ionization chamber.

11. A method for producing an electron beam for electron ionization, the method comprising:

producing electrons;

initially accelerating the electrons toward an ionization chamber;

decelerating the electrons that were initially accelerated to a level effective for forming a virtual cathode outside of the ionization chamber, the virtual cathode comprising the decelerated electrons; and accelerating the previously decelerated electrons as an electron beam from the virtual cathode into the ionization chamber.

12. The method of claim 11, comprising producing the electrons at an electron energy of about 20 eV or lower.

13. The method of claim 11, comprising decelerating the electrons to near zero velocity at a region where the virtual cathode is formed.

14. The method of claim 11, wherein accelerating the electrons toward the ionization chamber comprises applying a voltage to an electron extractor, and decelerating the electrons comprises applying a voltage to an electron lens of lesser magnitude than the voltage applied to the electron extractor, and wherein the virtual cathode is formed at the electron lens.

15. The method of claim 14, wherein producing the electrons comprises applying a voltage to a thermionic cathode, and wherein the voltage applied to the electron lens is of lesser magnitude than the voltage applied to the thermionic cathode.

16. The method of claim 14, wherein the electron extractor comprises an ion repeller, a body surrounding the ionization chamber, or both an ion repeller and a body surrounding the ionization chamber.

17. The method of claim 11, wherein accelerating the electrons toward the ionization chamber comprises applying respective voltages to a first electron lens and an electron extractor, and decelerating the electrons comprises applying a voltage to a second electron lens between the first electron lens and electron extractor, and wherein the voltage applied to the second electron lens is of lesser magnitude than the voltage applied to the electron extractor and the virtual cathode is formed at the second electron lens.

18. The method of claim 17, wherein the voltage applied to the second electron lens is of lesser magnitude than the voltage applied to the first electron lens.

19. The method of claim 17, wherein producing the electrons comprises applying a voltage to a thermionic cathode, and wherein the voltage applied to the first electron lens is of greater magnitude than the voltage applied to the thermionic cathode.

20. A method for analyzing sample material, the method comprising:

producing an electron beam according to the method of claim 11;

producing ions by directing sample material into the ionization chamber toward the electrons; and transmitting the ions from the ionization chamber to a mass analyzer.

* * * * *